US010609998B2

(12) United States Patent
Callis, Jr. et al.

(10) Patent No.: US 10,609,998 B2
(45) Date of Patent: Apr. 7, 2020

(54) AUTOMATIC HAIR BRAIDING SYSTEM

(71) Applicants: Lawrence Edward Callis, Jr., Hampton, VA (US); Maria Anita Richardson-Callis, Hampton, VA (US)

(72) Inventors: Lawrence Edward Callis, Jr., Hampton, VA (US); Maria Anita Richardson-Callis, Hampton, VA (US)

( * ) Notice: Subject to any disclaimer, the term of this patent is extended or adjusted under 35 U.S.C. 154(b) by 382 days.

(21) Appl. No.: 15/613,234

(22) Filed: Jun. 4, 2017

(65) Prior Publication Data

US 2018/0000217 A1 Jan. 4, 2018

Related U.S. Application Data

(60) Provisional application No. 62/346,014, filed on Jun. 6, 2016.

(51) Int. Cl.
*A45D 2/38* (2006.01)
*A45D 2/00* (2006.01)

(52) U.S. Cl.
CPC ..... *A45D 2/00* (2013.01); *A45D 2002/005* (2013.01)

(58) Field of Classification Search
CPC ..... A45D 2/00; A45D 2002/003; A45D 2002/005; A45D 2002/006
See application file for complete search history.

(56) References Cited

U.S. PATENT DOCUMENTS 4,307,737 A * 12/1981 Shipman ..... A45D 2/00 132/223
4,427,017 A * 1/1984 Eronini ..... A45D 2/00 132/271
5,988,181 A * 11/1999 Gable ..... A45D 2/00 132/200
6,164,289 A * 12/2000 Ogunro ..... A45D 2/00 132/210
6,520,187 B1 * 2/2003 Lee ..... A45D 2/00 132/210
6,575,175 B2 * 6/2003 Kim ..... A45D 2/00 132/210

(Continued)

*Primary Examiner* — Nicholas D Lucchesi
(74) *Attorney, Agent, or Firm* — Pharar Patents & Intellecutal Property; Andrew A. Pharar

(57) ABSTRACT

The automatic hair braiding device disclosed herein, when laid against an individual's head over a sectioned portion of hair, can further section and segregate the hair into smaller sections of a specific width automatically. The braiding device will be able to combine additional hair, synthetic or human, that is already pre-fed into the machine to the individual's sectioned hair and braid the individual's hair with integrated hair to the desired length simultaneously. The device will possess a safety feature that can sense hair tension while segregating and braiding hair to minimize hair breakage and notify the user if any added hair is not properly loaded or secured within the device before braiding begins. The device will have the ability to automatically shut off if hair should become tangled during any phase of the braiding process. The device will have the ability to program hair sectioning and braid size through computer software capability and mobile phone Bluetooth application. Users will have the ability to sanitize the device to maintain state regulated health and hygiene requirements.

7 Claims, 20 Drawing Sheets

(56) References Cited

U.S. PATENT DOCUMENTS

| | | | | |
|---|---|---|---|---|
| 6,662,808 | B2 * | 12/2003 | Leason | A45D 2/00 132/212 |
| 6,827,089 | B2 * | 12/2004 | Lee | A45D 2/00 132/212 |
| 7,069,935 | B2 * | 7/2006 | Bousfield | A45D 2/00 132/210 |
| 9,027,569 | B2 * | 5/2015 | Chung | A45D 7/00 132/212 |
| 9,060,582 | B2 * | 6/2015 | Longoria | A45D 2/12 |
| 9,144,284 | B2 * | 9/2015 | Chung | A45D 7/00 |
| 9,554,633 | B1 * | 1/2017 | Briggins | A45D 2/00 |
| 2004/0237991 | A1 * | 12/2004 | Glucksman | A45D 2/00 132/271 |
| 2017/0099927 | A1 * | 4/2017 | Whitehead | A45D 8/34 |

* cited by examiner

FIG. 22
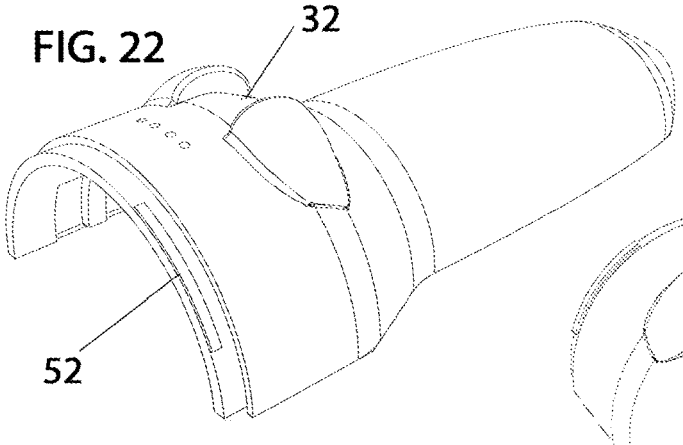
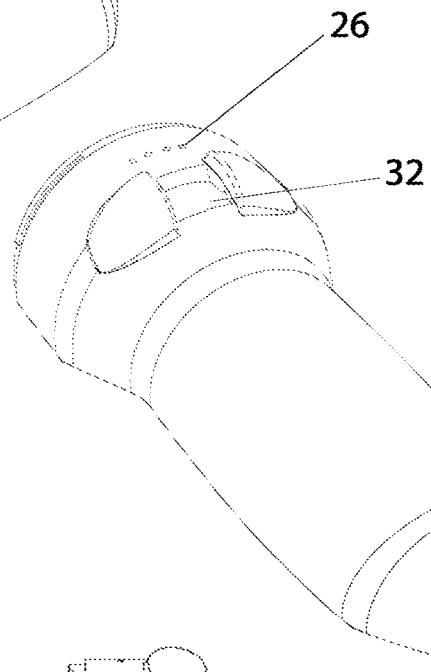
FIG. 23
FIG. 24
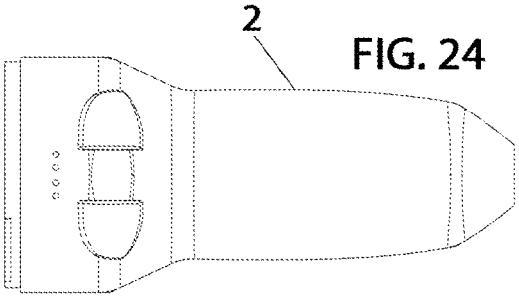
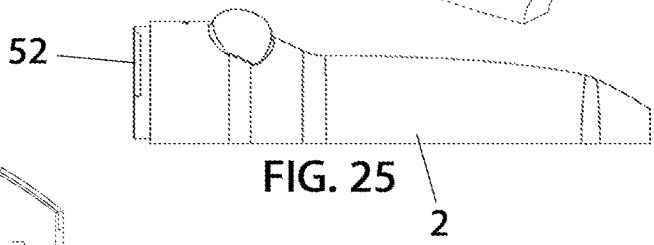
FIG. 25
FIG. 26
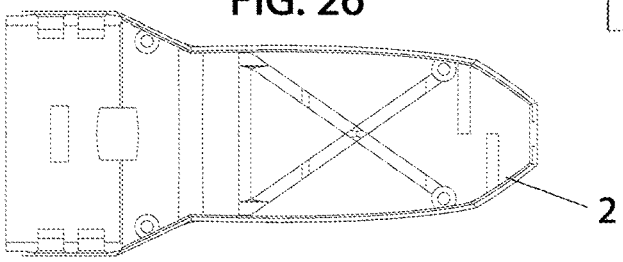
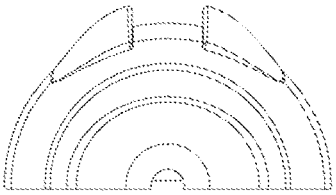
FIG. 27
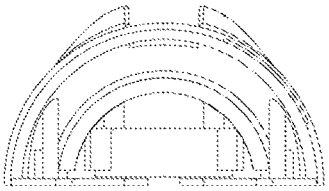
FIG. 28
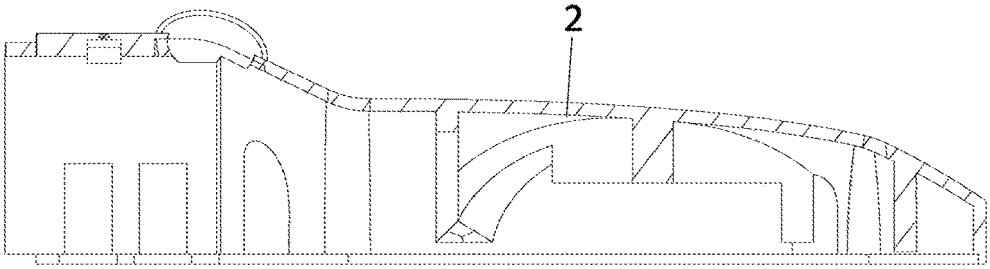
FIG. 29

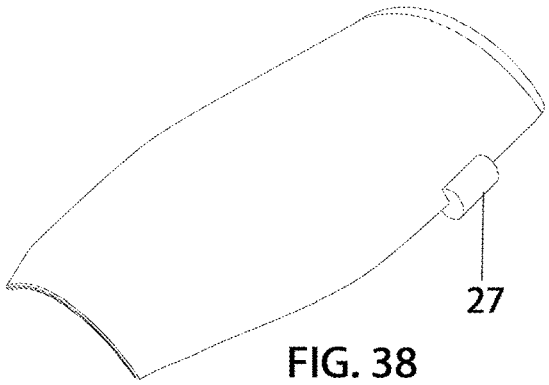
FIG. 38
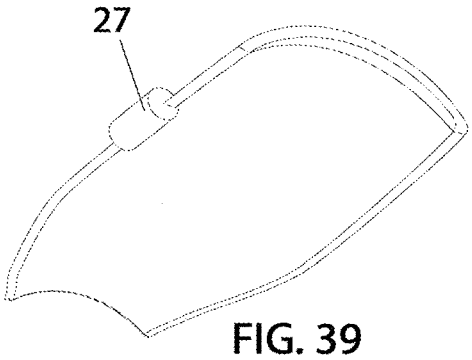
FIG. 39
FIG. 40
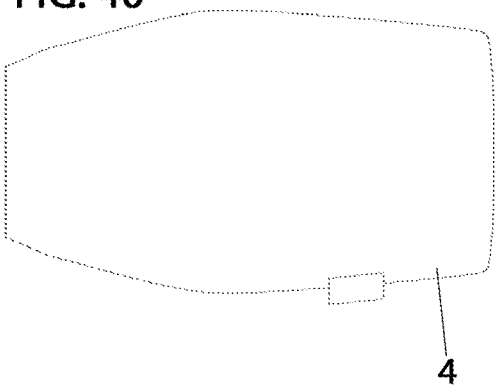
FIG. 41
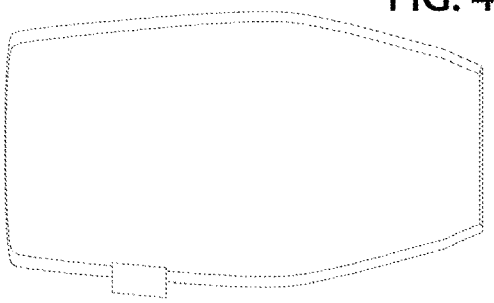
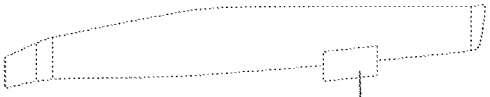
FIG. 42
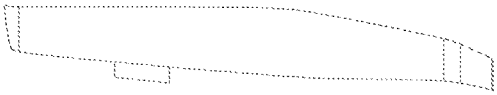
FIG. 43
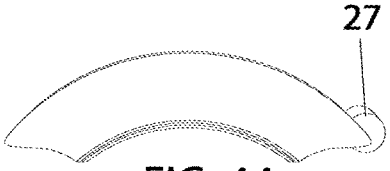
FIG. 44
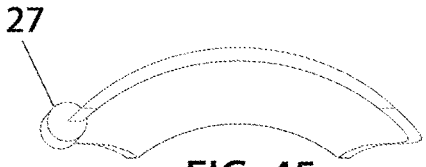
FIG. 45
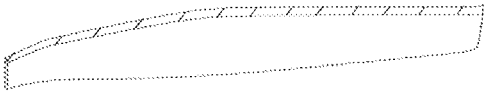
FIG. 46
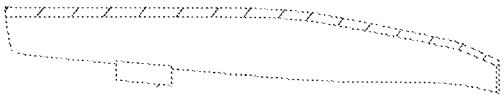
FIG. 47

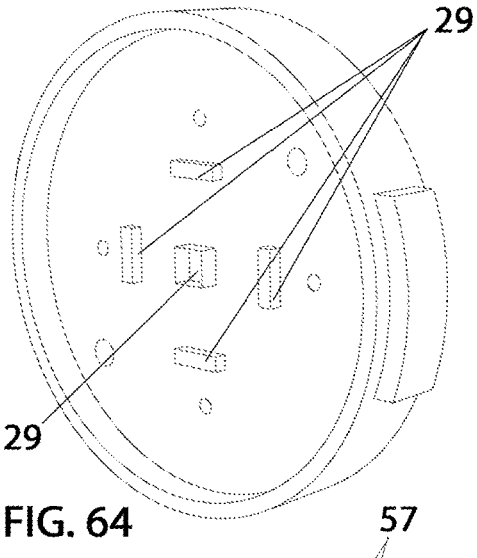
FIG. 64
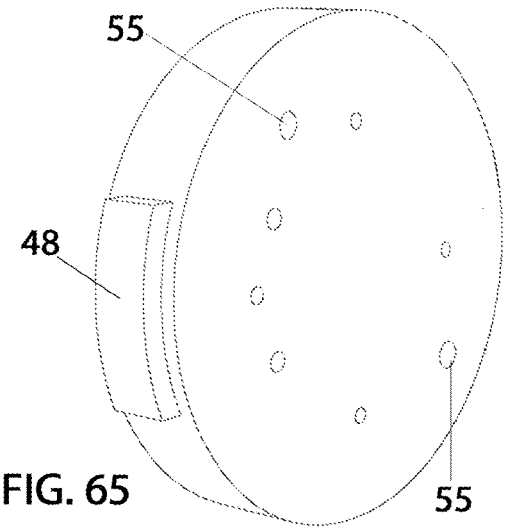
FIG. 65
FIG. 66
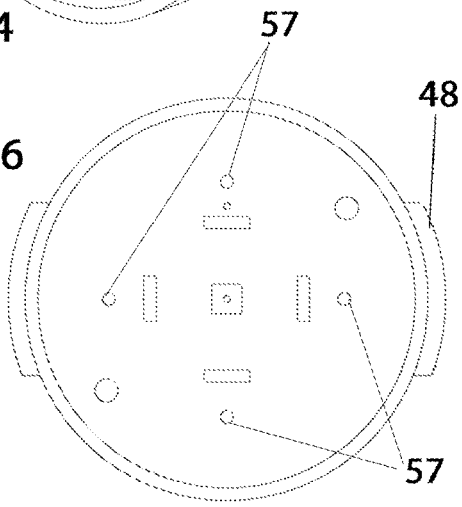
FIG. 67
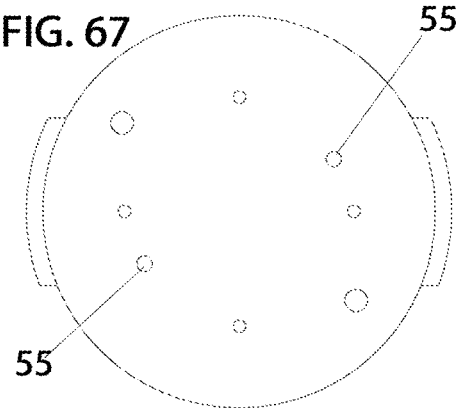
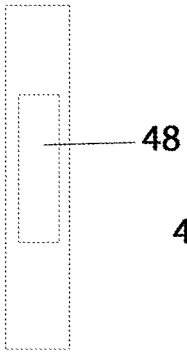
FIG. 68
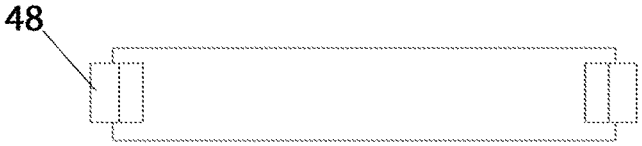
FIG. 69
FIG. 70
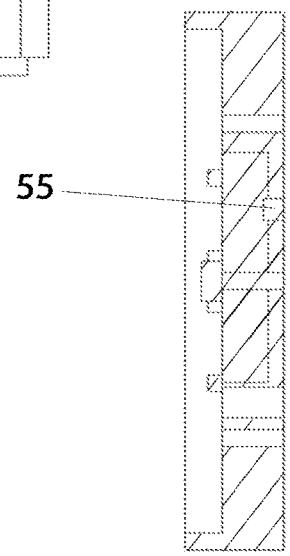
FIG. 71
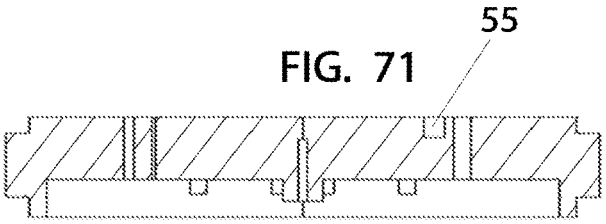

FIG. 72
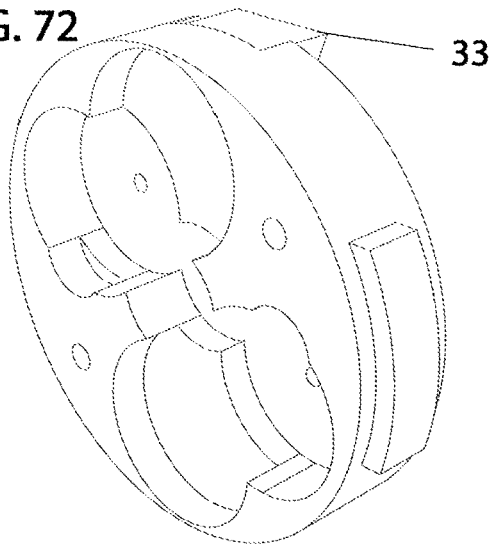
FIG. 73
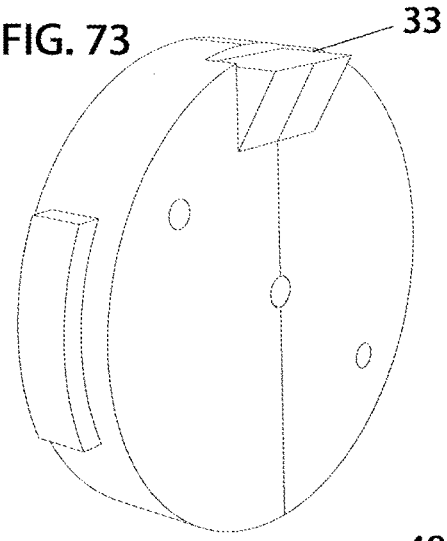
FIG. 74
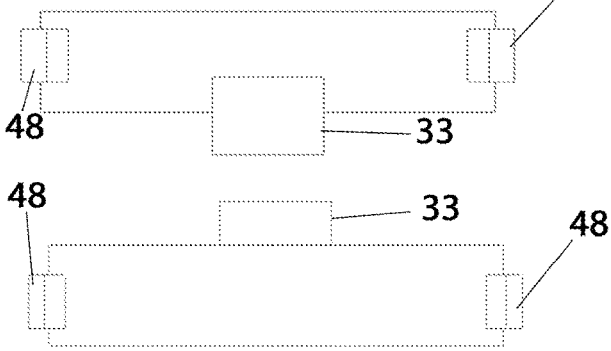
FIG. 75
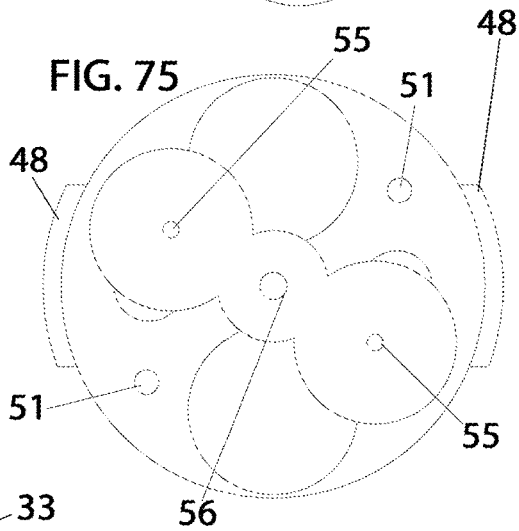
FIG. 76
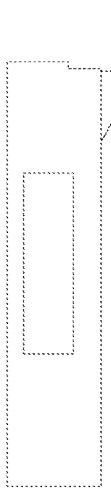
FIG. 77
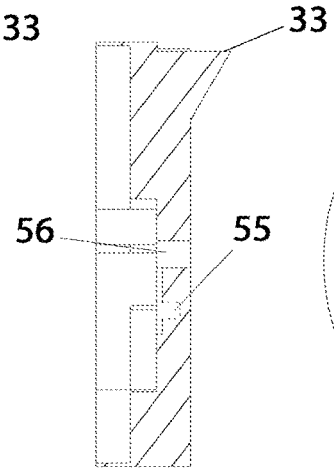
FIG. 78
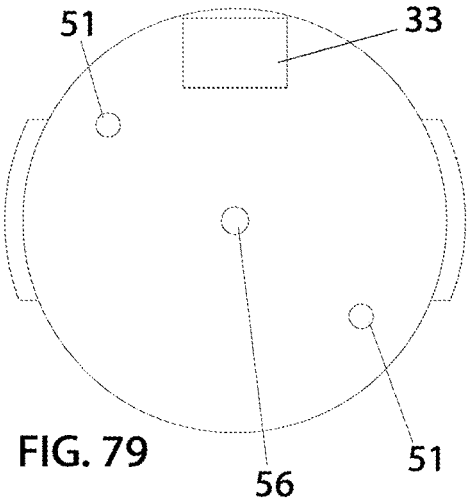
FIG. 79
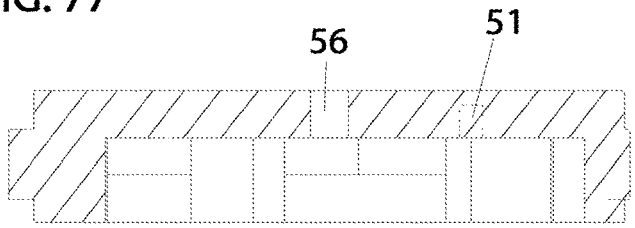
FIG. 80

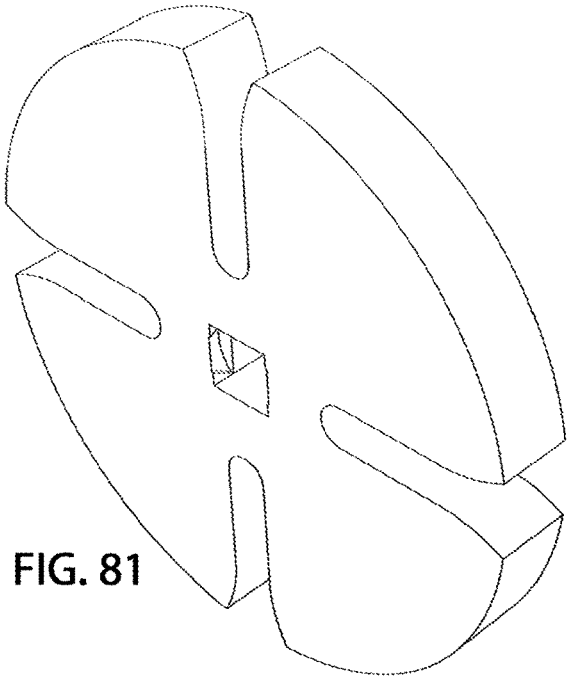
FIG. 81
FIG. 82
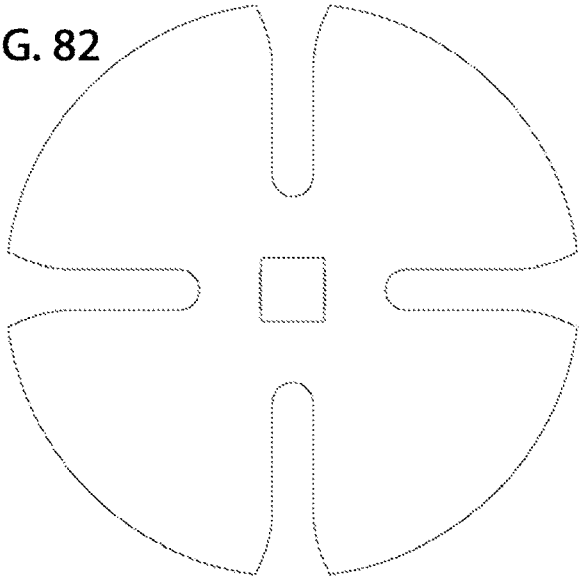
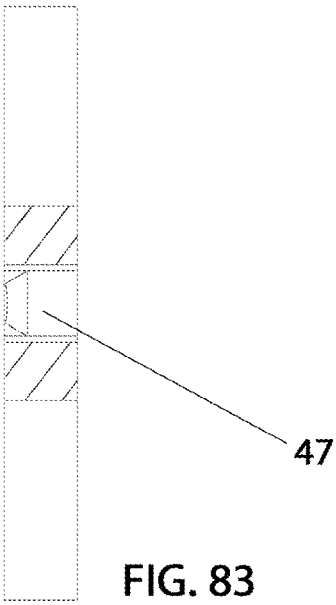
FIG. 83

FIG. 89
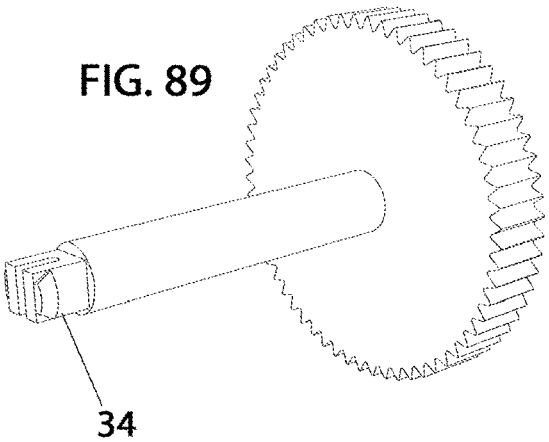
FIG. 90
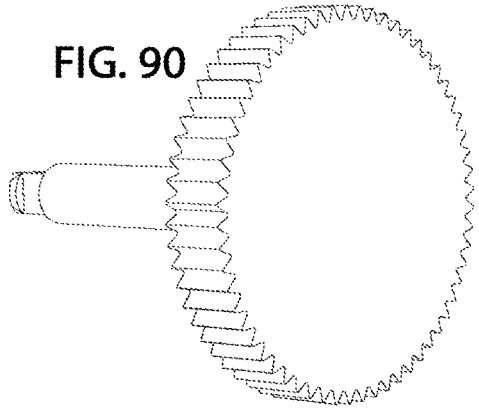
FIG. 91
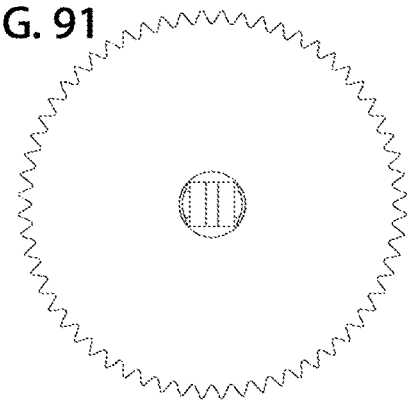
FIG. 92
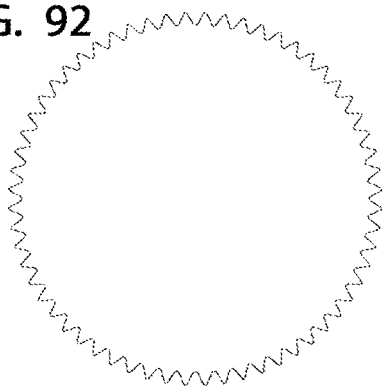
FIG. 93
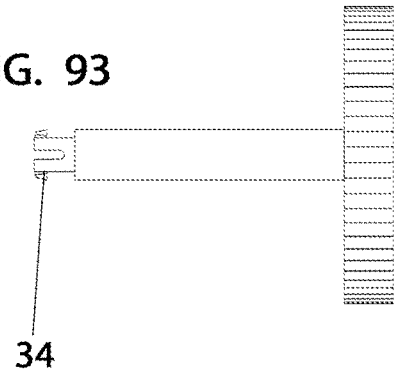
FIG. 94
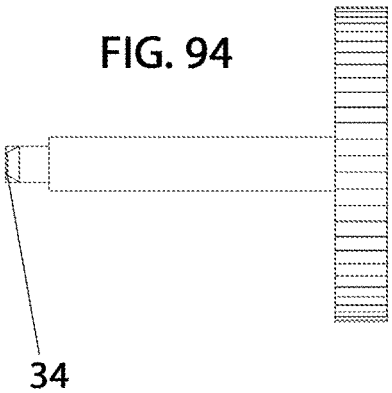
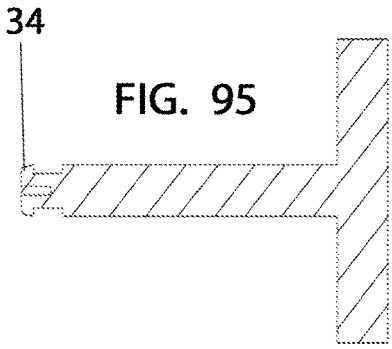
FIG. 95
FIG. 96
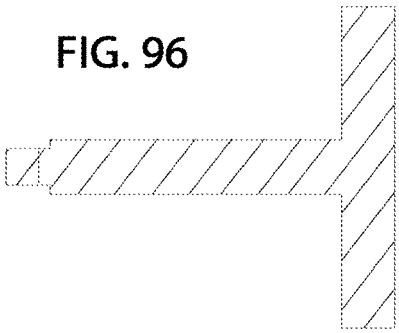

FIG. 108
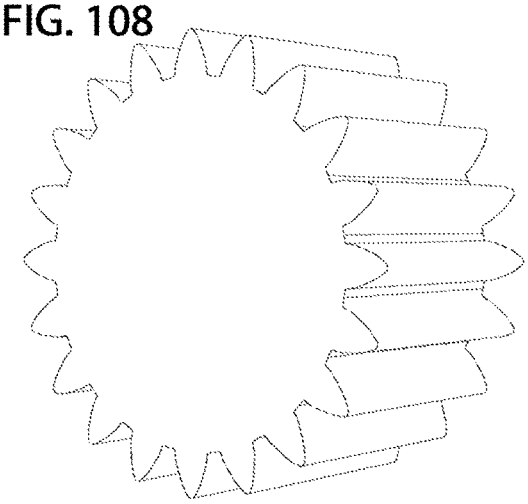
FIG. 109
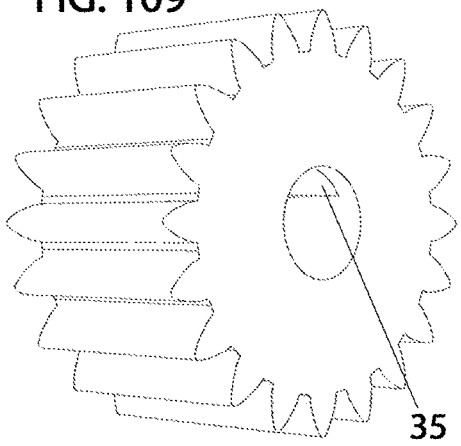
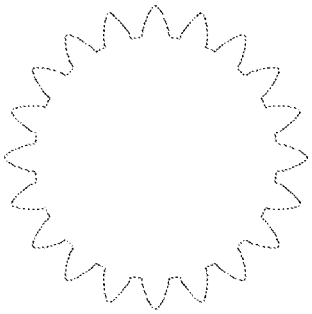
FIG. 110
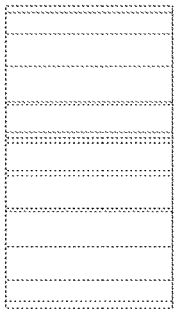
FIG. 111
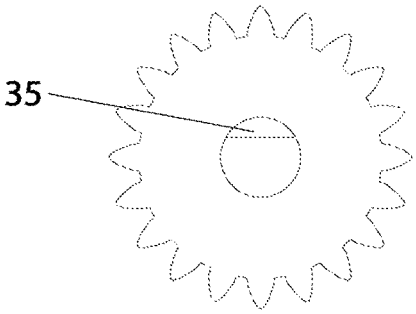
FIG. 112
FIG. 113
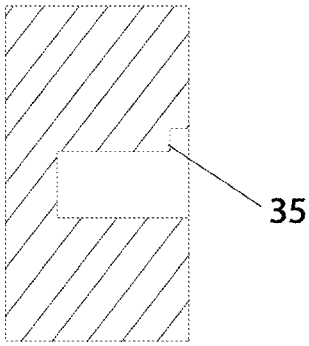
FIG. 114
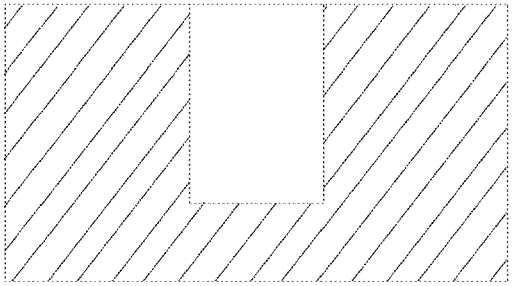
FIG. 115
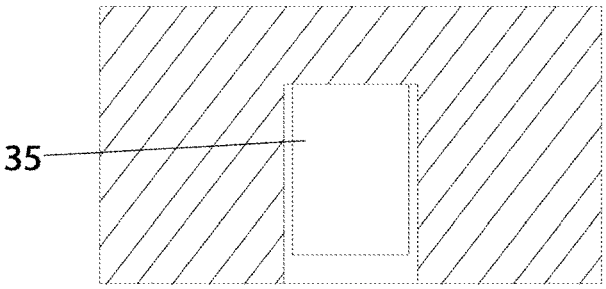

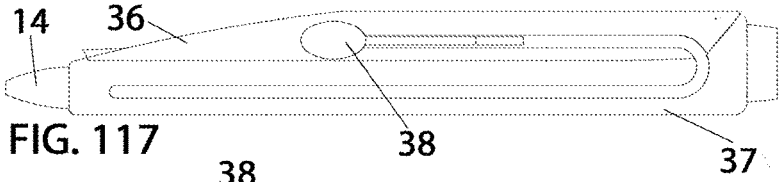
FIG. 117
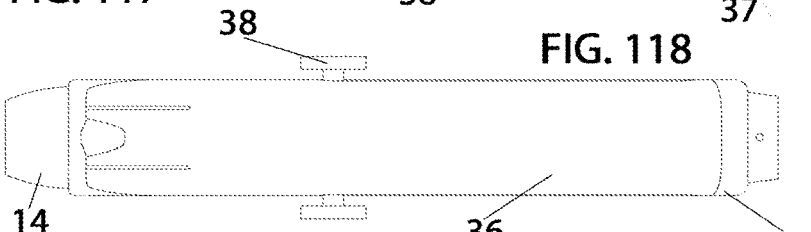
FIG. 118
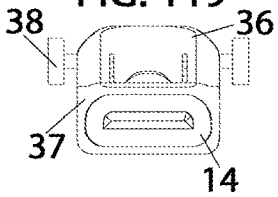
FIG. 119
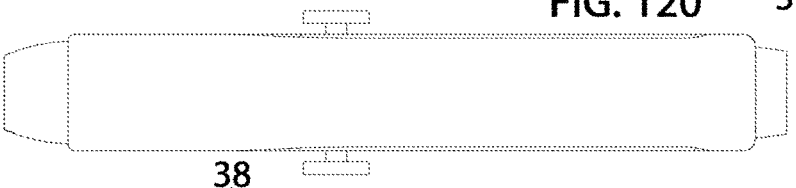
FIG. 120
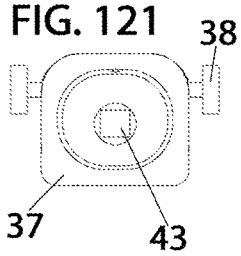
FIG. 121
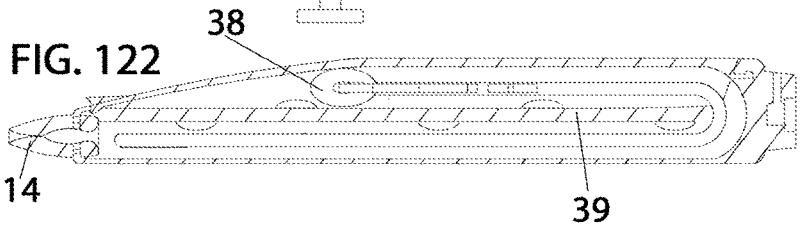
FIG. 122
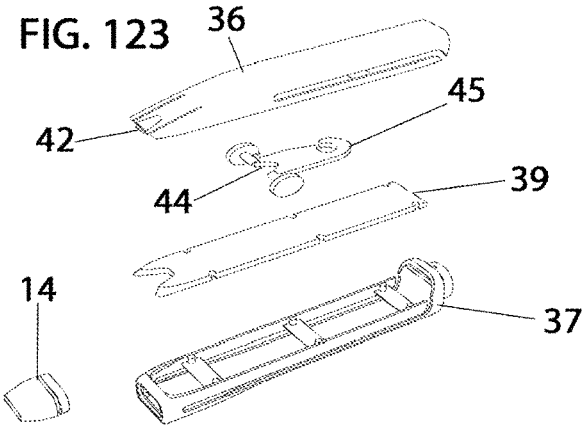
FIG. 123
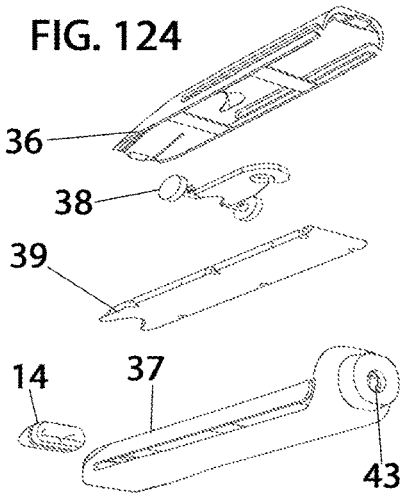
FIG. 124
FIG. 125
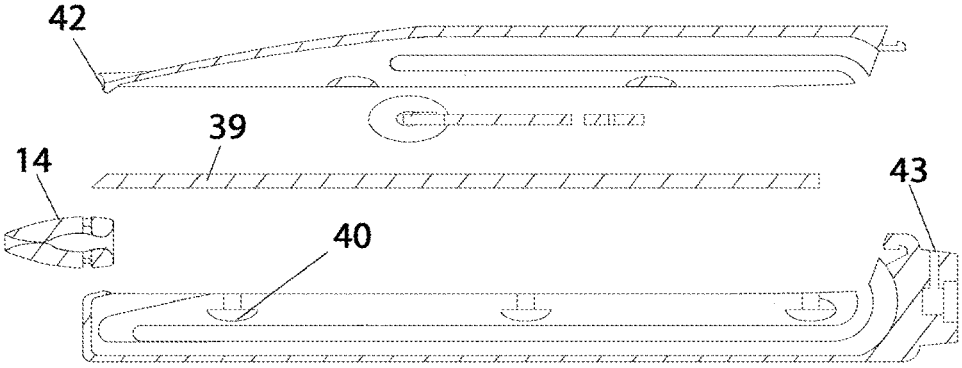

AUTOMATIC HAIR BRAIDING SYSTEM

CROSS REFERENCE TO RELATED PATENT APPLICATIONS

The present application incorporates by reference the entirety of provisional application 62/346,014 filed in the United States Patent and Trademark Office on Jun. 6, 2016.

STATEMENT REGARDING FEDERAL SPONSORSHIP

No part of this invention was a result of any federally sponsored research.

TECHNICAL FIELD OF THE INVENTION

The present invention relates in general to hair styling devices, and more specifically to hand-held, "do-it-yourself" automatic hair braiding devices comprising a safety device to detect hair tension, a safety device to detect proper hair loading, and an automatic shutoff device to detect tangling of hair within the device. Such a device further comprises computer software capability and mobile phone Bluetooth application capability for programming and control of a desired final length and twist style.

COPYRIGHT AND TRADEMARK NOTICE

A portion of the disclosure of this patent application may contain material that is subject to copyright protection. The owner has no objection to the facsimile reproduction by anyone of the patent document or the patent disclosure, as it appears in the Patent and Trademark Office patent file or records, but otherwise reserves all copyrights whatsoever.

Certain marks referenced herein may be common law or registered trademarks of third parties affiliated or unaffiliated with the applicant or the assignee. Use of these marks is by way of example and should not be construed as descriptive or to limit the scope of this invention to material associated only with such marks.

BACKGROUND OF THE INVENTION

Current hair braiding style techniques are time and labor intensive. Basic individual braid styling requires manual manipulation and addition of hair; resulting in hundreds of braids depending on the size of the individual's head, and requiring, on average, 4-16 hours to complete.

It is known to have manual hair braiding devices comprising one or more component parts and used to assist while the user manually braids their own or another's hair. Such a design can facilitate the braiding of an individual's hair, saving some time and effort as compared to an unassisted hair braiding process, but does not allow for the automatic braiding of an individual's hair. These devices still require intensive and repetitive labor to achieve the hair braiding objective. Such devices are commonly termed "Hair Braiding Tools" or "Hair Braiding Sponges."

It is known to have an automatic hair braiding device comprising one or more component parts and used to assist in the automatic hair braiding by a user of their own or another's hair. Such a design can facilitate the more rapid and automatic braiding of an individual's hair, but may not comprise a safety device for determining hair tension or a safety device for determining proper hair loading into the device. Such a device may or may not require manual loading of a user's hair into the device for braiding. These devices also may not comprise an automatic shutoff device for determining when a user's hair becomes tangled within the device. Also, these devices may not comprise computer integrated control or Bluetooth software capability to program the device. Such devices are commonly termed "Quick Hair Braiders," or "Automatic Hair Braiders."

There is a need in the art for a braiding device that, when laid against an individual's head over a sectioned portion of hair can further section and segregate the hair into smaller sections of a specific width automatically. The braiding device will be able to combine additional hair, synthetic or human, that is already pre-fed into the machine to the individual's sectioned hair and braid the individual's hair with integrated hair to the desired length simultaneously. The device will possess a safety feature that can sense hair tension while segregating and braiding hair to minimize hair breakage and notify the user if any added hair is not properly loaded or secured within the device before braiding begins. The device will have the ability to automatically shut off if hair should become tangled during any phase of the braiding process. The device will have the ability to program hair sectioning and braid size through computer software capability and mobile phone Bluetooth application. Users will have the ability to sanitize the device to maintain state regulated health and hygiene requirements.

It is to these ends that the present invention has been developed.

BRIEF SUMMARY OF THE INVENTION

To minimize the limitations in the prior art, and to minimize other limitations that will be apparent upon reading and understanding the present specification, the present invention describes an automatic hair-braiding device that can automatically section and braid a user's hair to a desired length and twist style.

It is an objective of the present invention to provide an automatic hair-braiding device that can automatically section and braid a user's hair to a desired length and twist rate, while incorporating a safety device to detect hair tension, a safety device to detect proper hair loading, and an automatic shutoff device to detect tangling of hair within the device. Such a device further comprises computer software capability and mobile phone Bluetooth application capability for programming and control of a desired final length and twist style.

These and other advantages and features of the present invention are described herein with specificity so as to make the present invention understandable to one of ordinary skill in the art, both with respect to how to practice the present invention and how to make the present invention.

BRIEF DESCRIPTION OF THE SEVERAL VIEWS OF THE DRAWINGS

Elements in the figures have not necessarily been drawn to scale in order to enhance their clarity and improve understanding of these various elements and embodiments of the invention. Furthermore, elements that are known to be common and well understood to those in the industry are not depicted in order to provide a clear view of the various embodiments of the invention.

FIG. 22 shows a front three-quarters perspective view of a rear top housing of an embodiment of the present invention noting a rocker switch hole 32 and a plurality of clips in a front housing 52.

FIG. 23 shows a rear three-quarters perspective view of a rear top housing of an embodiment of the present invention noting a plurality of holes in a rear top housing 26 for a plurality of LEDs and a rocker switch hole 32.

FIG. 24 shows a top view of a rear top housing of an embodiment of the present invention noting a rear top housing 2.

FIG. 25 shows a side view of a rear top housing of an embodiment of the present invention noting a rear top housing 2 and a plurality of clips in a front housing 52.

FIG. 26 shows a bottom view of a rear top housing of an embodiment of the present invention noting a rear top housing 2.

FIG. 27 shows a rear view of a rear top housing of an embodiment of the present invention.

FIG. 28 shows a front view of a rear top housing of an embodiment of the present invention.

FIG. 29 shows a cutaway view of a rear top housing of an embodiment of the present invention noting a rear top housing 2.

FIG. 38 shows a front three-quarters perspective view of a transparent lid of an embodiment of the present invention.

FIG. 39 shows a rear three-quarters perspective view of a transparent lid of an embodiment of the present invention.

FIG. 40 shows a top view of a transparent lid of an embodiment of the present invention noting a transparent cover 4.

FIG. 41 shows a bottom view of a transparent lid of an embodiment of the present invention.

FIG. 42 shows a left view of a transparent lid of an embodiment of the present invention noting a transparent cover hinge 27.

FIG. 43 shows a right view of a transparent lid of an embodiment of the present invention.

FIG. 44 shows a front view of a transparent lid of an embodiment of the present invention noting a transparent cover hinge 27.

FIG. 45 shows a rear view of a transparent lid of an embodiment of the present invention noting a transparent cover hinge 27.

FIG. 46 shows a cutaway left side view of a transparent lid of an embodiment of the present invention.

FIG. 47 shows a cutaway right side view of a transparent lid of an embodiment of the present invention.

FIG. 64 shows a front three-quarters perspective view of a middle transmission disk of an embodiment of the present invention noting a separate track support 29.

FIG. 65 shows a rear three-quarters perspective view of a middle transmission disk of an embodiment of the present invention noting a transition disk support 48.

FIG. 66 shows a front view of a middle transmission disk of an embodiment of the present invention noting a transition disk support 48 and a plurality of holes for gear axles 57.

FIG. 67 shows a rear view of a middle transmission disk of an embodiment of the present invention noting a plurality of holes for double gear axles 55.

FIG. 68 shows a side view of a middle transmission disk of an embodiment of the present invention noting a transition disk support 48.

FIG. 69 shows a top view of a middle transmission disk of an embodiment of the present invention noting a transition disk support 48.

FIG. 70 shows a cutaway left side view of a middle transmission disk of an embodiment of the present invention noting a plurality of holes for double gear axles 55.

FIG. 71 shows a cutaway top view of a middle transmission disk of an embodiment of the present invention noting a plurality of holes for double gear axles 55.

FIG. 72 shows a front three-quarters perspective view of a gear cover of an embodiment of the present invention noting a printed circuit board support 33.

FIG. 73 shows a rear three-quarters perspective view of a gear cover of an embodiment of the present invention noting a printed circuit board support 33.

FIG. 74 shows a top view of a gear cover of an embodiment of the present invention noting a printed circuit board support 33 and a transition disk support 48.

FIG. 75 shows a front view of a gear cover of an embodiment of the present invention noting a transition disk support 48, a plurality of holes for disk screws 51, a plurality of holes for double gear axles 55, and a hole for a motor gear axle 56.

FIG. 76 shows a bottom view of a gear cover of an embodiment of the present invention noting a printed circuit board support 33 and a transition disk support 48.

FIG. 77 shows a left side view of a gear cover of an embodiment of the present invention noting a printed circuit board support 33.

FIG. 78 shows a cutaway left side view of a gear cover of an embodiment of the present invention noting a printed circuit board support 33, a plurality of holes for double gear axles 55, and a hole for a motor gear axle 56.

FIG. 79 shows a rear view of a gear cover of an embodiment of the present invention noting a printed circuit board support 33, a plurality of holes for disk screws 51, and a hole for a motor gear axle 56.

FIG. 80 shows a cutaway top view of a gear cover of an embodiment of the present invention noting a plurality of holes for disk screws 51 and a hole for a motor gear axle 56.

FIG. 81 shows a front three-quarters perspective view of a horn of an embodiment of the present invention.

FIG. 82 shows a front view of a horn of an embodiment of the present invention.

FIG. 83 shows a cutaway left side view of a horn of an embodiment of the present invention noting a plurality of gear axle clips 47.

FIG. 89 shows a front three-quarters perspective view of a clockwise gear of an embodiment of the present invention noting a plurality of horn clips 34.

FIG. 90 shows a rear three-quarters perspective view of a clockwise gear of an embodiment of the present invention.

FIG. 91 shows a front view of a clockwise gear of an embodiment of the present invention.

FIG. 92 shows a rear view of a clockwise gear of an embodiment of the present invention.

FIG. 93 shows a left side view of a clockwise gear of an embodiment of the present invention noting a plurality of horn clips 34.

FIG. 94 shows a top view of a clockwise gear of an embodiment of the present invention noting a plurality of horn clips 34.

FIG. 95 shows a cutaway left side view of a clockwise gear of an embodiment of the present invention noting a plurality of horn clips 34.

FIG. 96 shows a cutaway top view of a clockwise gear of an embodiment of the present invention.

FIG. 108 shows a front three-quarters perspective view of a driver gear of an embodiment of the present invention.

FIG. 109 shows a rear three-quarters perspective view of a driver gear of an embodiment of the present invention noting a flat notch 35.

FIG. 110 shows a front view of a driver gear of an embodiment of the present invention.

FIG. 111 shows a left side view of a driver gear of an embodiment of the present invention.

FIG. 112 shows a rear view of a driver gear of an embodiment of the present invention noting a flat notch 35.

FIG. 113 shows a cutaway left side view of a driver gear of an embodiment of the present invention noting a flat notch 35.

FIG. 114 shows a cutaway top view of a driver gear of an embodiment of the present invention.

FIG. 115 shows a cutaway bottom view of a driver gear of an embodiment of the present invention noting a flat notch 35.

FIG. 117 shows a left side view of a hair chamber of an embodiment of the present invention noting a rubber nozzle 14, a hair chamber top 36, a hair chamber bottom 37, and a chamber hook 38.

FIG. 118 shows a top view of a hair chamber of an embodiment of the present invention noting a rubber nozzle 14, a hair chamber top 36, a hair chamber bottom 37, and a chamber hook 38.

Figure 1:
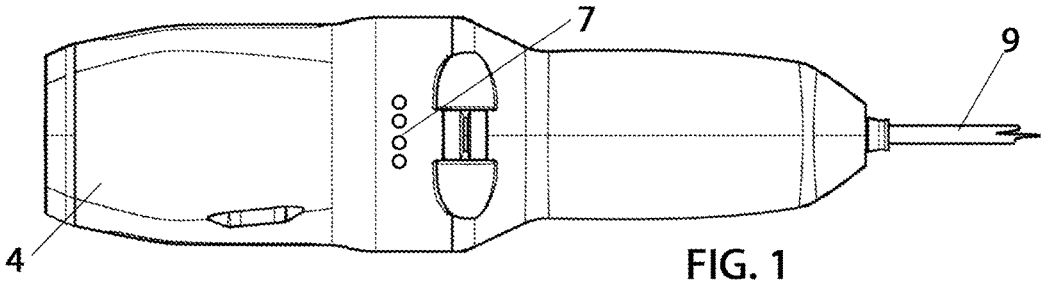
FIG. 1 shows a top view of an embodiment of the present invention noting a transparent cover 4, a plurality of LED lights 7, and a rubber power supply cable ring 9.

FIG. 119 shows a front view of a hair chamber of an embodiment of the present invention noting a rubber nozzle 14, a hair chamber bottom 37, and a chamber hook 38.

FIG. 120 shows a bottom view of a hair chamber of an embodiment of the present invention.

FIG. 121 shows a rear view of a hair chamber of an embodiment of the present invention noting a hair chamber bottom 37, a chamber hook 38, and a plurality of holes for support rods 43.

FIG. 122 shows a cutaway left side view of a hair chamber of an embodiment of the present invention noting a rubber nozzle 14, a chamber hook 38, and a chamber divider 39.

FIG. 123 shows an exploded front three-quarters perspective view of a hair chamber of an embodiment of the present invention noting a rubber nozzle 14, a hair chamber top 36, a hair chamber bottom 37, a chamber divider 39, a release for a chamber top 42, a recess for a hook release 44, and a loading hook 45.

FIG. 124 shows an exploded rear three-quarters perspective view of a hair chamber of an embodiment of the present invention noting a rubber nozzle 14, a hair chamber top 36, a hair chamber bottom 37, a chamber hook 38, a chamber divider 39, and a plurality of holes for support rods 43.

FIG. 125 shows an exploded cutaway left side view of a hair chamber of an embodiment of the present invention noting a rubber nozzle 14, a chamber divider 39, a chamber support for a divider 40, a release for a chamber top 42, and a plurality of holes for support rods 43.

REFERENCE NUMERAL SCHEDULE

[1] Rear Bottom Housing
[2] Rear Top Housing
[3] Front Housing
[4] Transparent Cover
[5] Transparent Side Panel
[6] Rocker Switch
[7] LED Lights
[8] Hair Loading Chambers
[9] Rubber Power Supply Cable Ring
[10] Horns

[11] Support Rods
[12] Electric Motor
[13] Printed Circuit Board
[14] Rubber Nozzle
[15] Track Disk Screws
[16] Main Track Disk
[17] Middle Transmission Disk
[18] 60 Tooth Clockwise Gears
[19] 60 Tooth Counter-clockwise Gears
[20] Double Gears
[21] Driver Gear
[22] Gear Cover
[23] Rear Housing Screws
[24] Grip for Rocker Switch
[25] Printed Circuit Board with LEDs
[26] Holes in the Rear Top Housing for LEDs
[27] Transparent Cover Hinge
[28] Rocker Switch
[29] Separate Track Support
[30] Holes for Screws
[31] Wiring
[32] Rocker Switch Hole
[33] Printed Circuit Board Support
[34] Horn Clips
[35] Flat Notch
[36] Hair Chamber Top
[37] Hair Chamber Bottom
[38] Chamber Hook
[39] Chamber Divider
[40] Chamber Support for Divider
[41] Hole for Releasing Rods
[42] Release for Chamber Top
[43] Holes for Support Rods
[44] Recess for Hook Release
[45] Loading Hook
[46] Double Gear Axles
[47] Gear Axles Clip
[48] Transition Disk Support
[49] Center Track Support
[50] Motor Axle
[51] Holes for Disk Screws
[52] Clips in a Front Housing
[53] Recess for See-Through Panel
[54] Support for Printed Circuit Board
[55] Holes for Double Gear Axles
[56] Hole for Motor Axle
[57] Holes for Gear Axles
[58] Long Grooves

DETAILED DESCRIPTION OF THE INVENTION

Certain terminology is used in the following description for reference only and is not limiting. The words "front," "rear," "anterior," "posterior," "lateral," "medial," "upper," "lower," "outer," "inner," and "interior" refer to directions toward and away from, respectively, the geometric center of the invention, and designated parts thereof, in accordance with the present disclosure. Unless specifically set forth herein, the terms "a," "an," and "the" are not limited to one element, but instead should be read as meaning "at least one." The terminology includes the words noted above, derivatives thereof, and words of similar import.

In function the automatic hair braiding device described herein is pre-loaded with hair, whether human or synthetic, and then laid against a pre-sectioned area of hair on a user's scalp. The device manipulates the sectioned hair, segregating the hair simultaneously into four or more smaller sections. The device further segregates the hair by looping a durable hair thread around the sectioned hair. The device then adds the pre-loaded hair to the user's hair around the initial parted and segregated section, securing all of the hair together and disengaging the wrapped hair thread when all of the hair is combined and secured. Each barrel rotates around the others such that the hair sections are manipulated, forming a braid pattern and moving downward as each pattern is completed. The device is powered on and off from the rocker switch.

The automatic hair braiding device comprises four or more hair chambers that will cleanly part the hair. The plurality of hair chambers will operate within the device housing, and each hair chamber is capable of braiding one individual braid, with each chamber affixed to a toothed gear that runs on an infinity-looped track within a larger disk allowing the barrels to rotate around each other and affecting a braid weaving pattern. The hair chambers will be removable for ease of cleaning and sanitizing between users with recommended cleaning solution to be available separately.

The automatic hair braiding device further comprises a printed circuit board giving the device the ability to be programmed by direct connection to a computer or through Bluetooth connectivity to a mobile device. The user will be able to program the length and pattern of the hair partitioning, braid thickness, and activate or deactivate the number of braid barrels needed. The processor will also have the capability of detecting hair tension to minimize hair breakage during the whole process from segregating the hair sections to the finished product of braiding. Additionally, the processor will detect if any process is hindered due to hair tangling and stop all operations within the device until the hindrance is resolved.

The automatic hair braiding device further comprises a power cord to ensure maximum power is delivered to the device for all components to operate optimally, and comprises a design small enough to be hand held and capable of braiding a minimum of 4 braids at a time, reducing the overall time and labor required to complete the braiding process.

The various embodiments of the invention have advantageous features not present in conventional automatic hair braiding devices. The automatic hair braiding device disclosed herein, when laid against an individual's head over a sectioned portion of hair, can further section and segregate the hair into smaller sections of a specific width automatically. The braiding device will be able to combine additional hair, synthetic or human, that is already pre-fed into the machine to the individual's sectioned hair and braid the individual's hair with integrated hair to the desired length simultaneously. The device will possess a safety feature that can sense hair tension while segregating and braiding hair to minimize hair breakage and notify the user if any added hair is not properly loaded or secured within the device before braiding begins. The device will have the ability to automatically shut off if hair should become tangled during any phase of the braiding process. The device will have the ability to program hair sectioning and braid size through computer software capability and mobile phone Bluetooth application. Users will have the ability to sanitize the device to maintain state regulated health and hygiene requirements.

In the following discussion that addresses a number of embodiments and applications of the present invention, reference is made to the accompanying drawings that form a part thereof, where depictions are made, by way of illustration, of specific embodiments in which the invention may be practiced. It is to be understood that other embodiments may be utilized and changes may be made without departing from the scope of the invention.

FIGS. 1-12 illustrate an automatic hair braiding device from various perspectives. The figures show an overall view of the device in its functional composition, and the relative positioning of the various components of the device when fully assembled.

FIG. 1 shows a top view of an embodiment of the present invention noting a transparent cover 4, a plurality of LED lights 7, and a rubber power supply cable ring 9.

Figure 2:
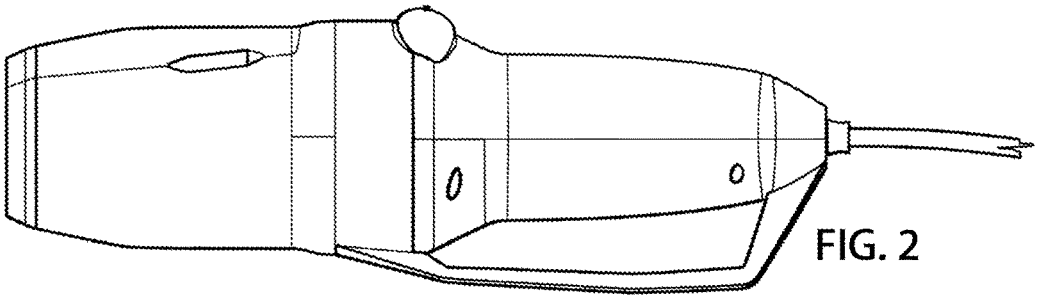
FIG. 2 shows a left side view of an embodiment of the present invention.

FIG. 2 shows a left side view of an embodiment of the present invention.

Figure 3:
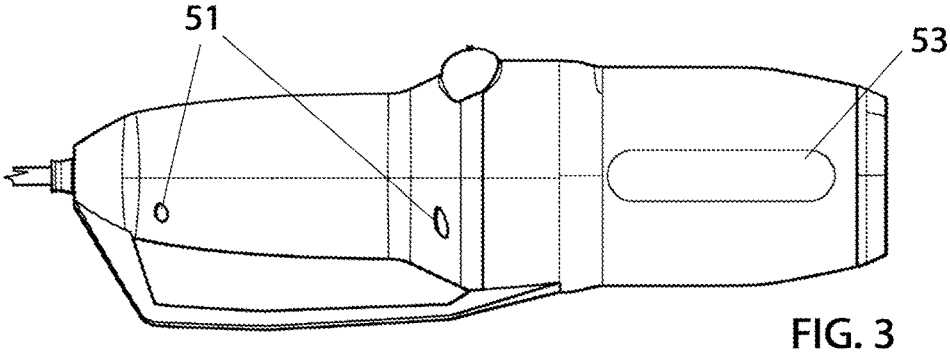
FIG. 3 shows a right side view of an embodiment of the present invention noting a plurality of holes for screws 51 and a recess for a see-through panel 53.

FIG. 3 shows a right side view of an embodiment of the present invention noting a plurality of holes for screws 51 and a recess for a see-through panel 53.

Figure 4:
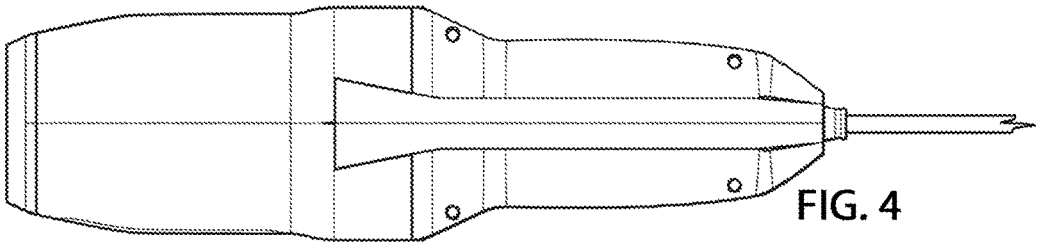
FIG. 4 shows a bottom view of an embodiment of the present invention.

FIG. 4 shows a bottom view of an embodiment of the present invention.

Figure 5:
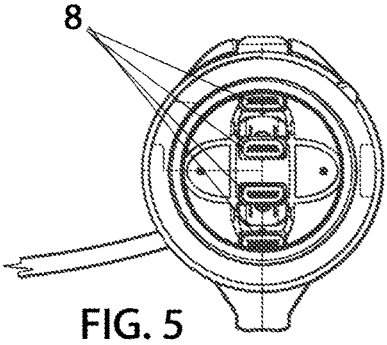
FIG. 5 shows a front view of an embodiment of the present invention noting a plurality of hair loading chambers 8.

FIG. 5 shows a front view of an embodiment of the present invention noting a plurality of hair loading chambers 8.

Figure 6:
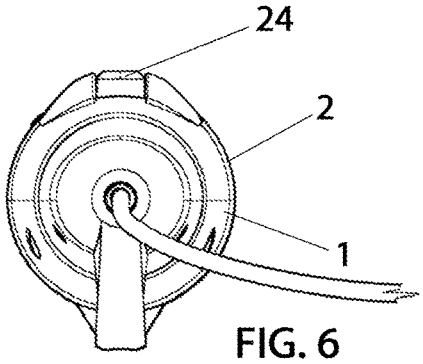
FIG. 6 shows a rear view of an embodiment of the present invention noting a rear bottom housing 1, a rear top housing 2, and a grip for a rocker switch 24.

FIG. 6 shows a rear view of an embodiment of the present invention noting a rear bottom housing 1, a rear top housing 2, and a grip for a rocker switch 24.

Figure 7:
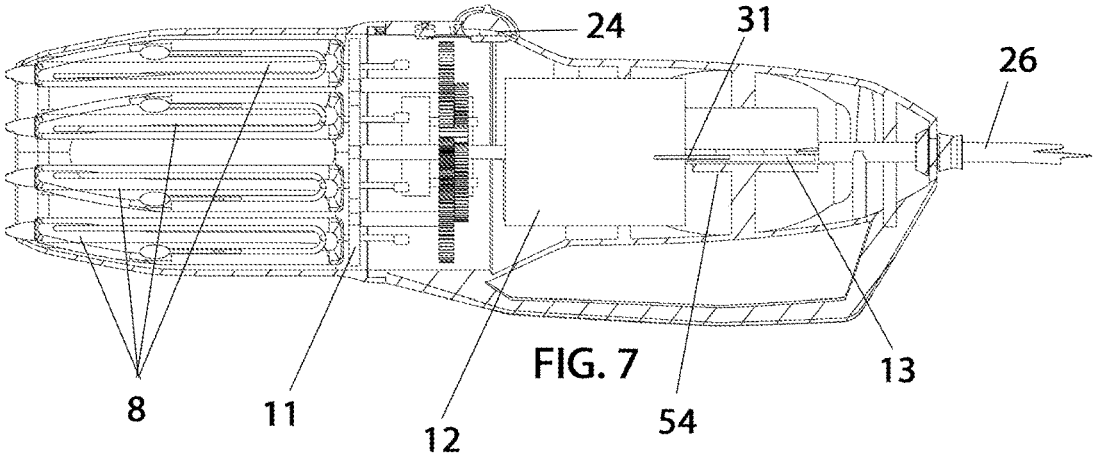
FIG. 7 shows a cutaway side view of an embodiment of the present invention noting a plurality of hair loading chambers 8, a plurality of support rods 11, an electric motor 12, and a printed circuit board 13. The figure further illustrates a grip for a rocker switch 24, a plurality of holes in a rear top housing 26 for a plurality of LEDs, a plurality of wiring 31, and a support 54 for a printed circuit board.

FIG. 7 shows a cutaway side view of an embodiment of the present invention noting a plurality of hair loading chambers 8, a plurality of support rods 11, an electric motor 12, and a printed circuit board 13. The figure further illustrates a grip for a rocker switch 24, a plurality of holes in a rear top housing 26 for a plurality of LEDs, a plurality of wiring 31, and a support 54 for a printed circuit board.

Figure 8:
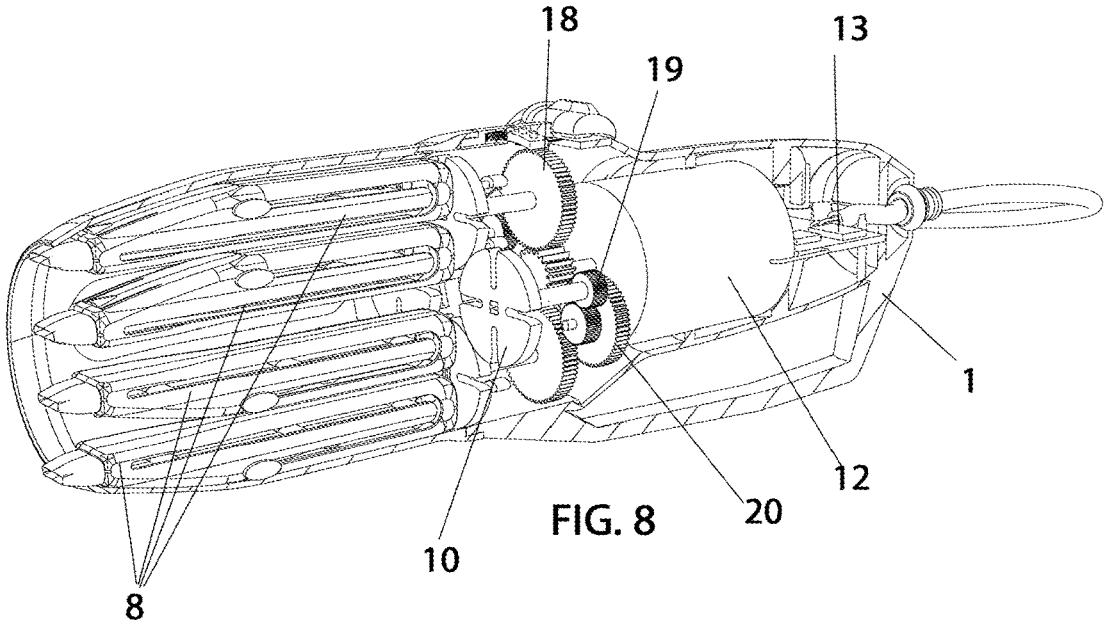
FIG. 8 shows a cutaway front three-quarters perspective view of an embodiment of the present invention noting a rear bottom housing 1, a plurality of hair loading chambers 8, a plurality of horns 10, an electric motor 12, and a printed circuit board 13. The figure further illustrates a plurality of 60-tooth clockwise gears 18, a plurality of 60-tooth counter-clockwise gears 19, and a plurality of double gears 20.

FIG. 8 shows a cutaway front three-quarters perspective view of an embodiment of the present invention noting a rear bottom housing 1, a plurality of hair loading chambers 8, a plurality of horns 10, an electric motor 12, and a printed circuit board 13. The figure further illustrates a plurality of 60-tooth clockwise gears 18, a plurality of 60-tooth counter-clockwise gears 19, and a plurality of double gears 20.

Figure 9:
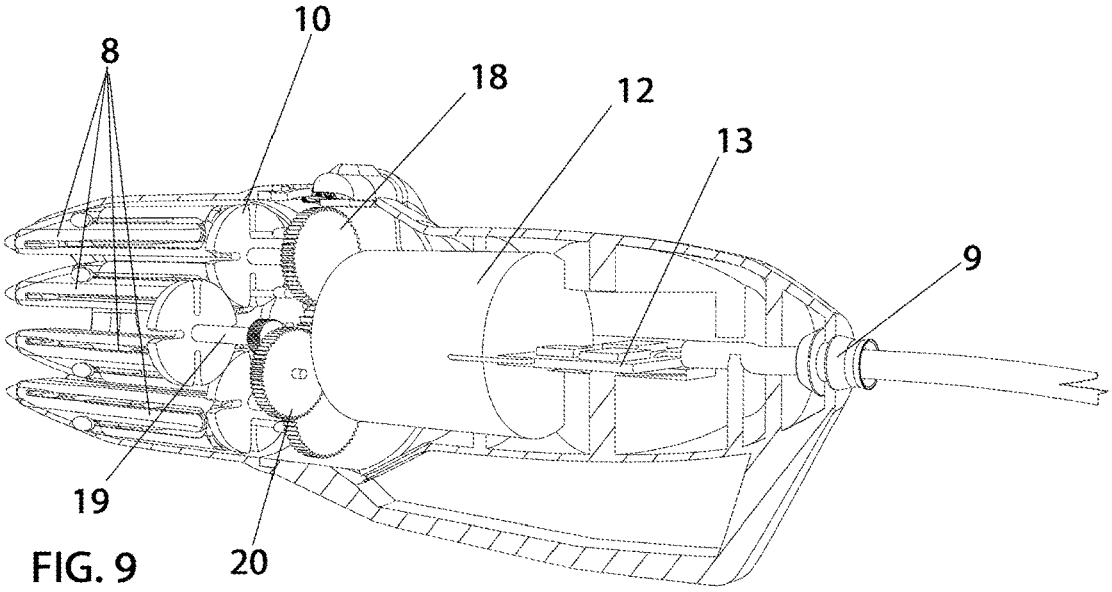
FIG. 9 shows a cutaway rear three-quarters perspective view of an embodiment of the present invention noting a plurality of hair loading chambers 8, a rubber power supply cable ring 9, an electric motor 12, and a printed circuit board 13. The figure further illustrates a plurality of 60-tooth clockwise gears 18, a plurality of 60-tooth counter-clockwise gears 19, and a plurality of double gears 20.

FIG. 9 shows a cutaway rear three-quarters perspective view of an embodiment of the present invention noting a plurality of hair loading chambers 8, a rubber power supply cable ring 9, an electric motor 12, and a printed circuit board 13. The figure further illustrates a plurality of 60-tooth clockwise gears 18, a plurality of 60-tooth counter-clockwise gears 19, and a plurality of double gears 20.

Figure 10:
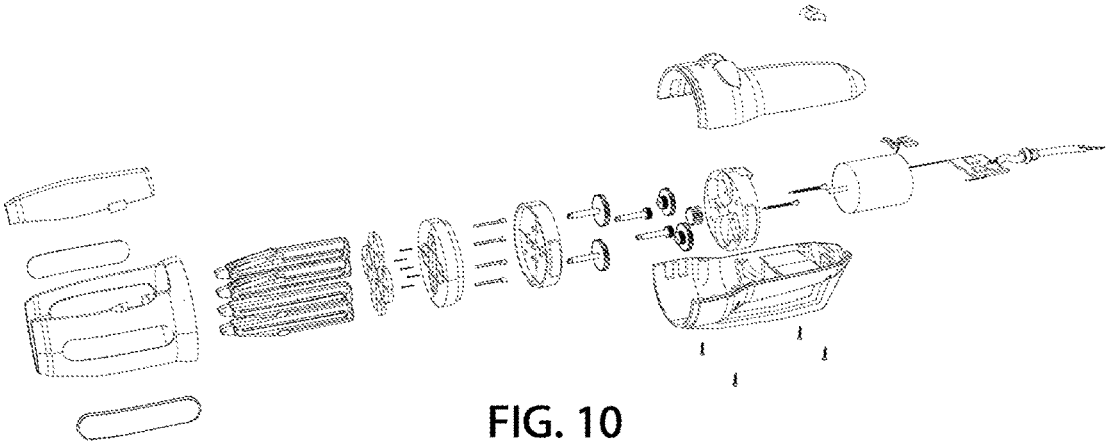
FIG. 10 shows an exploded front three-quarters perspective view of an embodiment of the present invention.

FIG. 10 shows an exploded front three-quarters perspective view of an embodiment of the present invention.

Figure 11:
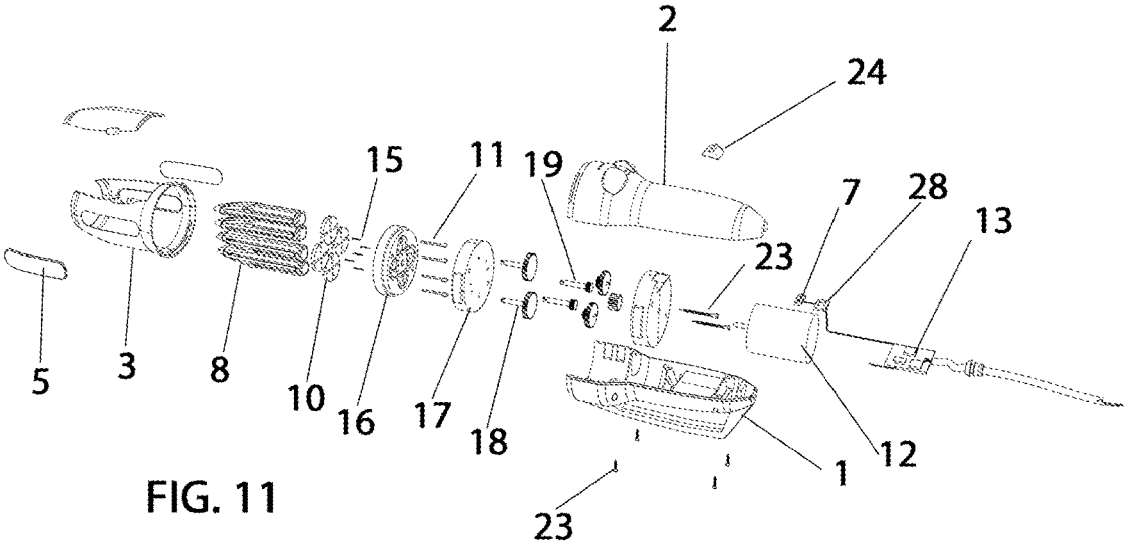
FIG. 11 shows an exploded rear three-quarters perspective view of an embodiment of the present invention noting a rear bottom housing 1, a rear top housing 2, a front housing 3, a transparent side panel 5, a plurality of LED lights 7, a plurality of hair loading chambers 8, a plurality of horns 10, a plurality of support rods 11, and an electric motor 12. The figure further illustrates a printed circuit board 13, a plurality of track disk screws 15, a main track disk 16, a middle transmission disk 17, a plurality of 60-tooth clockwise gears 18, a plurality of 60-tooth counter-clockwise gears 19, a plurality of rear housing screws 23, and a grip for a rocker switch 24.

FIG. 11 shows an exploded rear three-quarters perspective view of an embodiment of the present invention noting a rear bottom housing 1, a rear top housing 2, a front housing 3, a transparent side panel 5, a plurality of LED lights 7, a plurality of hair loading chambers 8, a plurality of horns 10, a plurality of support rods 11, and an electric motor 12. The figure further illustrates a printed circuit board 13, a plurality of track disk screws 15, a main track disk 16, a middle transmission disk 17, a plurality of 60-tooth clockwise gears 18, a plurality of 60-tooth counter-clockwise gears 19, a plurality of rear housing screws 23, and a grip for a rocker switch 24.

Figure 12:
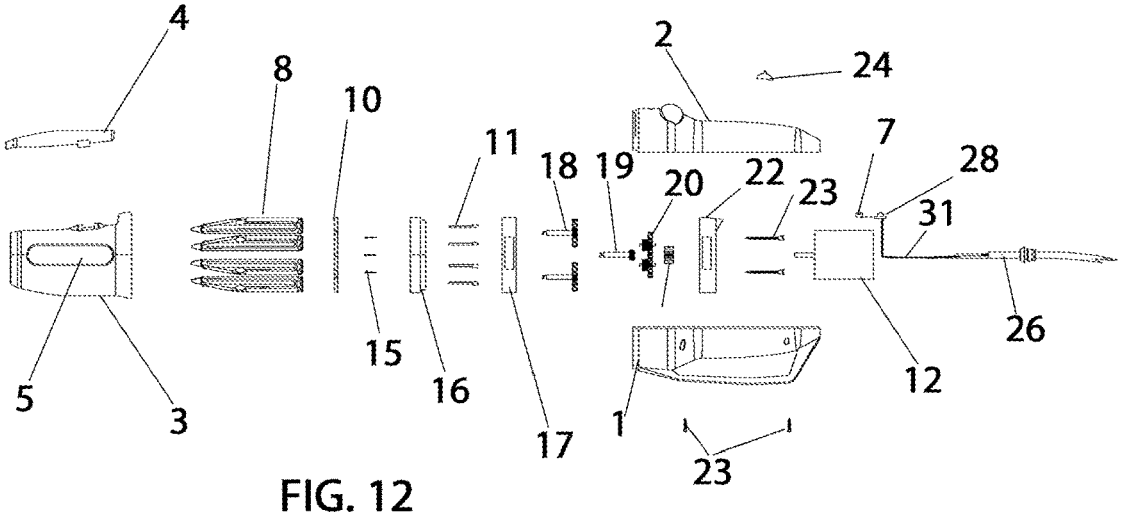
FIG. 12 shows an exploded side view of an embodiment of the present invention noting a rear bottom housing 1, a rear top housing 2, a front housing 3, a transparent cover 4, a transparent side panel 5, a plurality of LED lights 7, a plurality of hair loading chambers 8, a plurality of horns 10, a plurality of support rods 11, and an electric motor 12. The figure further illustrates a plurality of track disk screws 15, a main track disk 16, a middle transmission disk 17, a plurality of 60-tooth clockwise gears 18, a plurality of 60-tooth counter-clockwise gears 19, a gear cover 22, a plurality of rear housing screws 23, a grip for a rocker switch 24, a plurality of holes in a rear top housing 26 for a plurality of LEDs, a rocker switch 28, and a plurality of wiring 31.

FIG. 12 shows an exploded side view of an embodiment of the present invention noting a rear bottom housing 1, a rear top housing 2, a front housing 3, a transparent cover 4, a transparent side panel 5, a plurality of LED lights 7, a plurality of hair loading chambers 8, a plurality of horns 10, a plurality of support rods 11, and an electric motor 12. The figure further illustrates a plurality of track disk screws 15, a main track disk 16, a middle transmission disk 17, a plurality of 60-tooth clockwise gears 18, a plurality of 60-tooth counter-clockwise gears 19, a gear cover 22, a plurality of rear housing screws 23, a grip for a rocker switch 24, a plurality of holes in a rear top housing 26 for a plurality of LEDs, a rocker switch 28, and a plurality of wiring 31.

FIGS. 13-21 illustrate a front housing of an automatic hair braiding device from various perspectives. The front housing of the device envelopes and retains the plurality of hair loading chambers used in the braiding process. The hair of a user is inserted into and through the front housing of the device during the braiding process. The front housing of the device further protects the plurality of hair loading chambers from impact damage if the device should be dropped.

Figure 13:
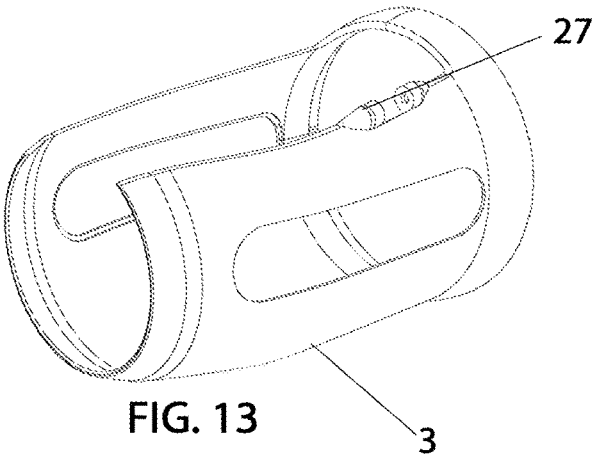
FIG. 13 shows a front three-quarters perspective view of a front housing of an embodiment of the present invention noting a front housing 3 and a transparent cover hinge 27.

FIG. 13 shows a front three-quarters perspective view of a front housing of an embodiment of the present invention noting a front housing 3 and a transparent cover hinge 27.

Figure 14:
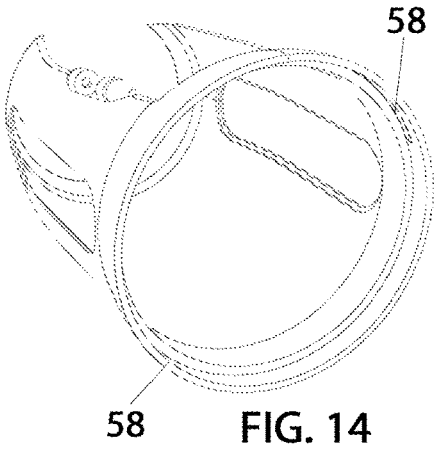
FIG. 14 shows a rear three-quarters perspective view of a front housing of an embodiment of the present invention noting a plurality of long grooves 58.

FIG. 14 shows a rear three-quarters perspective view of a front housing of an embodiment of the present invention noting a plurality of long grooves 58.

Figure 15:
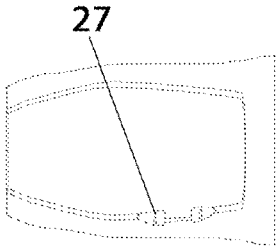
FIG. 15 shows a top view of a front housing of an embodiment of the present invention noting a transparent cover hinge 27.

FIG. 15 shows a top view of a front housing of an embodiment of the present invention noting a transparent cover hinge 27.

Figure 16:
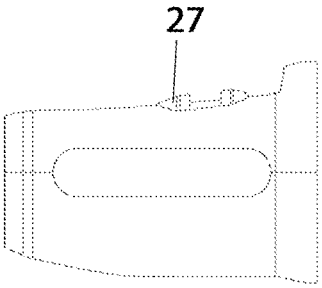
FIG. 16 shows a left view of a front housing of an embodiment of the present invention noting a transparent cover hinge 27.

FIG. 16 shows a left view of a front housing of an embodiment of the present invention noting a transparent cover hinge 27.

Figure 17:
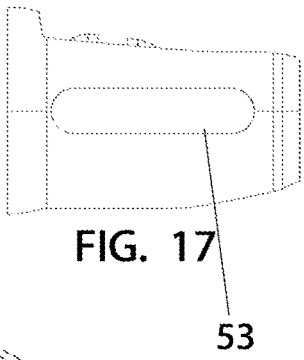
FIG. 17 shows a right view of a front housing of an embodiment of the present invention noting a recess for a see-through panel 53.

FIG. 17 shows a right view of a front housing of an embodiment of the present invention noting a recess for a see-through panel 53.

Figure 18:
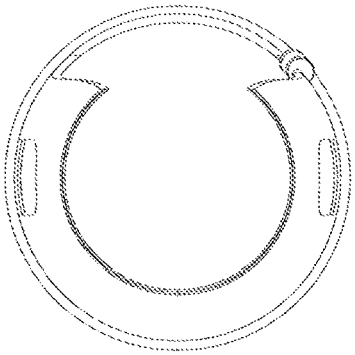
FIG. 18 shows a front view of a front housing of an embodiment of the present invention.

FIG. 18 shows a front view of a front housing of an embodiment of the present invention.

Figure 19:
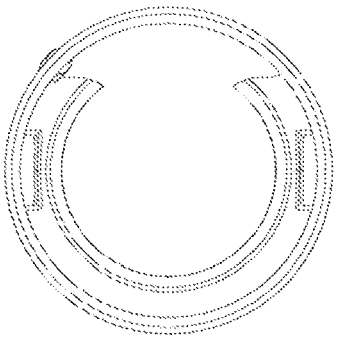
FIG. 19 shows a rear view of a front housing of an embodiment of the present invention.

FIG. 19 shows a rear view of a front housing of an embodiment of the present invention.

Figure 20:
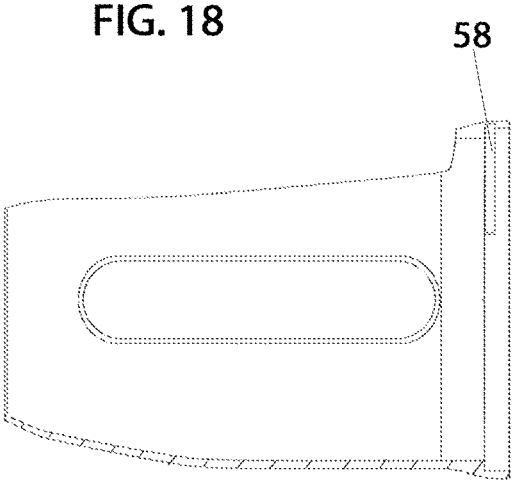
FIG. 20 shows a cutaway right side view of a front housing of an embodiment of the present invention noting a plurality of long grooves 58.

FIG. 20 shows a cutaway right side view of a front housing of an embodiment of the present invention noting a plurality of long grooves 58.

Figure 21:
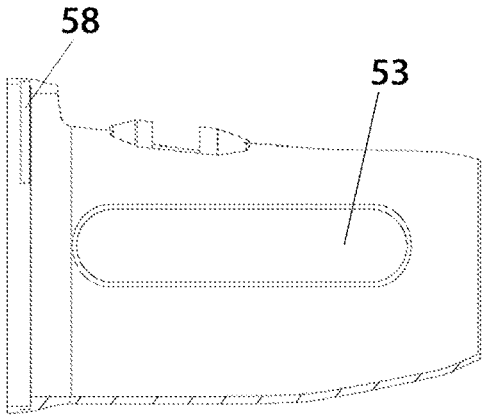
FIG. 21 shows a cutaway left side view of a front housing of an embodiment of the present invention noting a recess for a see-through panel 53 and a plurality of long grooves 58.

FIG. 21 shows a cutaway left side view of a front housing of an embodiment of the present invention noting a recess for a see-through panel 53 and a plurality of long grooves 58.

FIGS. 22-29 illustrate a rear top housing of an automatic hair braiding device from various perspectives. The rear top housing of the device partially envelops and retains the gear mechanism and electrical components of the automatic hair braiding system. The rear top housing further comprises a plurality of holes and openings for the installation of LEDs and a rocker switch to start or stop the device. The rear top housing, in combination with the rear bottom housing, further protects the gear mechanism and electrical components of the hair braiding device from dirt contamination and impact damage if the device should be dropped.

FIG. 22 shows a front three-quarters perspective view of a rear top housing of an embodiment of the present invention noting a rocker switch hole 32 and a plurality of clips in a front housing 52.

FIG. 23 shows a rear three-quarters perspective view of a rear top housing of an embodiment of the present invention noting a plurality of holes in a rear top housing 26 for a plurality of LEDs and a rocker switch hole 32.

FIG. 24 shows a top view of a rear top housing of an embodiment of the present invention noting a rear top housing 2.

FIG. 25 shows a side view of a rear top housing of an embodiment of the present invention noting a rear top housing 2 and a plurality of clips in a front housing 52.

FIG. 26 shows a bottom view of a rear top housing of an embodiment of the present invention noting a rear top housing 2.

FIG. 27 shows a rear view of a rear top housing of an embodiment of the present invention.

FIG. 28 shows a front view of a rear top housing of an embodiment of the present invention.

FIG. 29 shows a cutaway view of a rear top housing of an embodiment of the present invention noting a rear top housing 2.

FIGS. 30-37 illustrate a rear bottom housing of an automatic hair braiding device from various perspectives. The rear bottom housing of the device partially envelops and retains the gear mechanism and electrical components of the automatic hair braiding system. The rear bottom housing further comprises a hand grip for the manipulation and control of the automatic hair braiding system. The rear bottom housing, in combination with the rear top housing, further protects the gear mechanism and electrical components of the hair braiding device from dirt contamination and impact damage if the device should be dropped.

Figure 30:
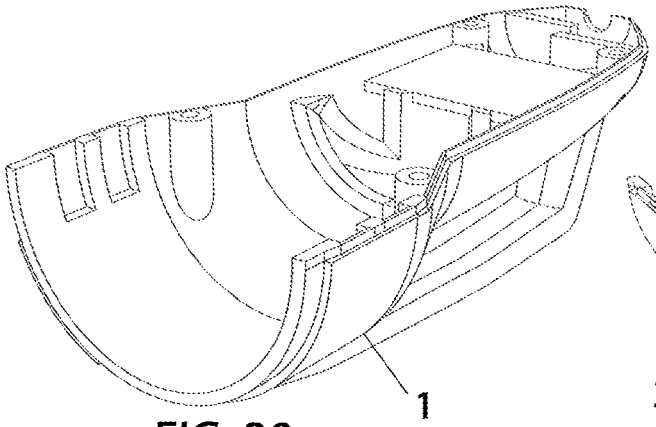
FIG. 30 shows a front three-quarters perspective view of a rear bottom housing of an embodiment of the present invention noting a rear bottom housing 1.

FIG. 30 shows a front three-quarters perspective view of a rear bottom housing of an embodiment of the present invention noting a rear bottom housing 1.

Figure 31:
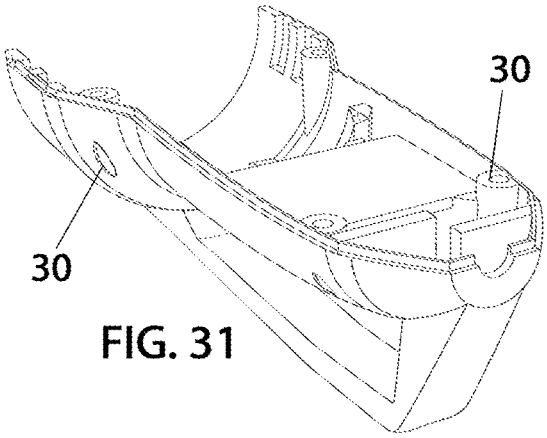
FIG. 31 shows a rear three-quarters perspective view of a rear bottom housing of an embodiment of the present invention noting a plurality of holes for screws 30.

FIG. 31 shows a rear three-quarters perspective view of a rear bottom housing of an embodiment of the present invention noting a plurality of holes for screws 30.

Figure 32:
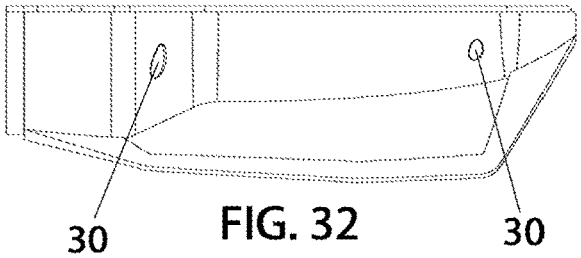
FIG. 32 shows a side view of a rear bottom housing of an embodiment of the present invention noting a plurality of holes for screws 30.

FIG. 32 shows a side view of a rear bottom housing of an embodiment of the present invention noting a plurality of holes for screws 30.

Figure 33:
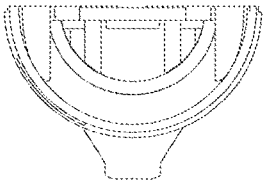
FIG. 33 shows a front view of a rear bottom housing of an embodiment of the present invention.

FIG. 33 shows a front view of a rear bottom housing of an embodiment of the present invention.

Figure 34:
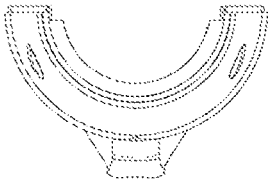
FIG. 34 shows a rear view of a rear bottom housing of an embodiment of the present invention.

FIG. 34 shows a rear view of a rear bottom housing of an embodiment of the present invention.

Figure 35:
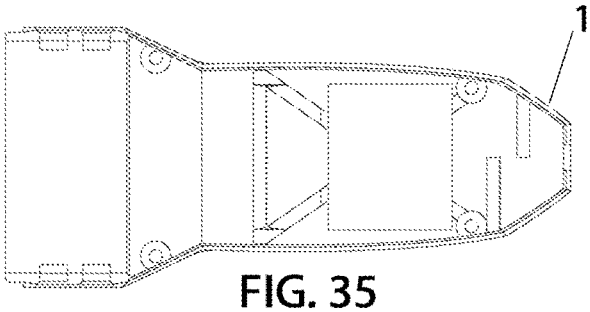
FIG. 35 shows a top view of a rear bottom housing of an embodiment of the present invention noting a rear bottom housing 1.

FIG. 35 shows a top view of a rear bottom housing of an embodiment of the present invention noting a rear bottom housing 1.

Figure 36:
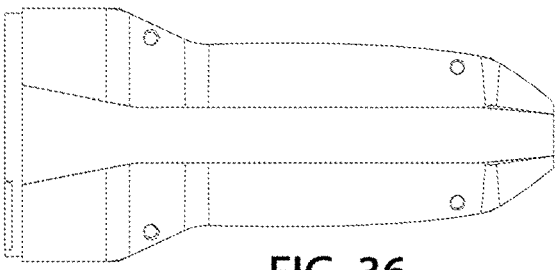
FIG. 36 shows a rear view of a rear bottom housing of an embodiment of the present invention.

FIG. 36 shows a rear view of a rear bottom housing of an embodiment of the present invention.

Figure 37:
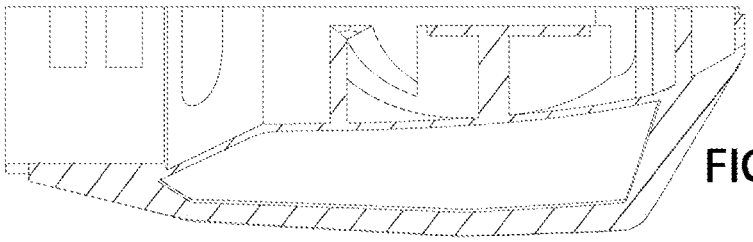
FIG. 37 shows a cutaway view of a rear bottom housing of an embodiment of the present invention.

FIG. 37 shows a cutaway view of a rear bottom housing of an embodiment of the present invention.

FIGS. 38-47 illustrate a transparent lid of an automatic hair braiding device from various perspectives. The transparent lid articulates with the front housing of the automatic hair braiding system, and allows for the hair of a user to be inserted into and through the front housing of the device during the braiding process.

FIG. 38 shows a front three-quarters perspective view of a transparent lid of an embodiment of the present invention.

FIG. 39 shows a rear three-quarters perspective view of a transparent lid of an embodiment of the present invention.

FIG. 40 shows a top view of a transparent lid of an embodiment of the present invention noting a transparent cover 4.

FIG. 41 shows a bottom view of a transparent lid of an embodiment of the present invention.

FIG. 42 shows a left view of a transparent lid of an embodiment of the present invention noting a transparent cover hinge 27.

FIG. 43 shows a right view of a transparent lid of an embodiment of the present invention.

FIG. 44 shows a front view of a transparent lid of an embodiment of the present invention noting a transparent cover hinge 27.

FIG. 45 shows a rear view of a transparent lid of an embodiment of the present invention noting a transparent cover hinge 27.

FIG. 46 shows a cutaway left side view of a transparent lid of an embodiment of the present invention.

FIG. 47 shows a cutaway right side view of a transparent lid of an embodiment of the present invention.

FIGS. 48-54 illustrate a transparent side panel of an automatic hair braiding device from various perspectives. The transparent side panels attach to the front housing of the automatic hair braiding device and allow for monitoring of a user's hair during the braiding process.

Figure 48:
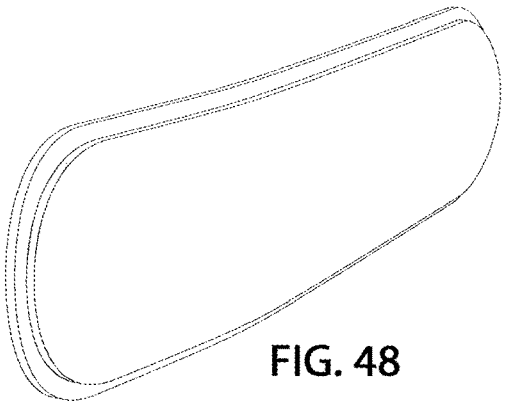
FIG. 48 shows a front three-quarters perspective view of a transparent side panel of an embodiment of the present invention.

FIG. 48 shows a front three-quarters perspective view of a transparent side panel of an embodiment of the present invention.

Figure 49:
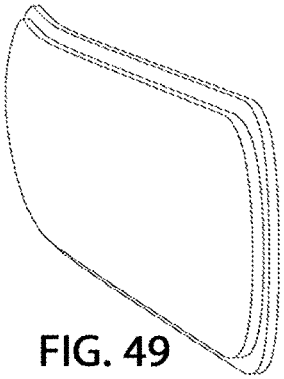
FIG. 49 shows a rear three-quarters perspective view of a transparent side panel of an embodiment of the present invention.

FIG. 49 shows a rear three-quarters perspective view of a transparent side panel of an embodiment of the present invention.

Figure 50:
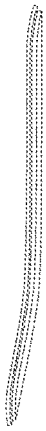
FIG. 50 shows a bottom view of a transparent side panel of an embodiment of the present invention.

FIG. 50 shows a bottom view of a transparent side panel of an embodiment of the present invention.

Figure 51:
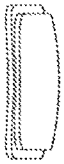
FIG. 51 shows a front view of a transparent side panel of an embodiment of the present invention.

FIG. 51 shows a front view of a transparent side panel of an embodiment of the present invention.

Figure 52:
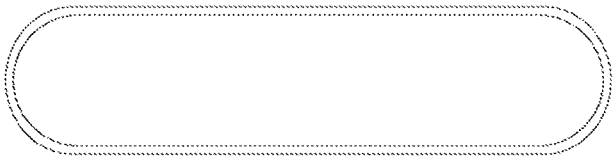
FIG. 52 shows a side view of a transparent side panel of an embodiment of the present invention.

FIG. 52 shows a side view of a transparent side panel of an embodiment of the present invention.

Figure 53:
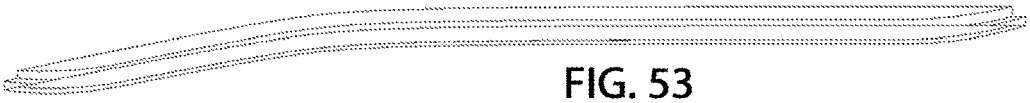
FIG. 53 shows a top view of a transparent side panel of an embodiment of the present invention.

FIG. 53 shows a top view of a transparent side panel of an embodiment of the present invention.

Figure 54:
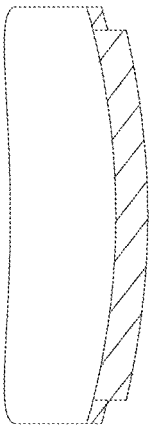
FIG. 54 shows a cutaway front view of a transparent side panel of an embodiment of the present invention.

FIG. 54 shows a cutaway front view of a transparent side panel of an embodiment of the present invention.

Figure 55:
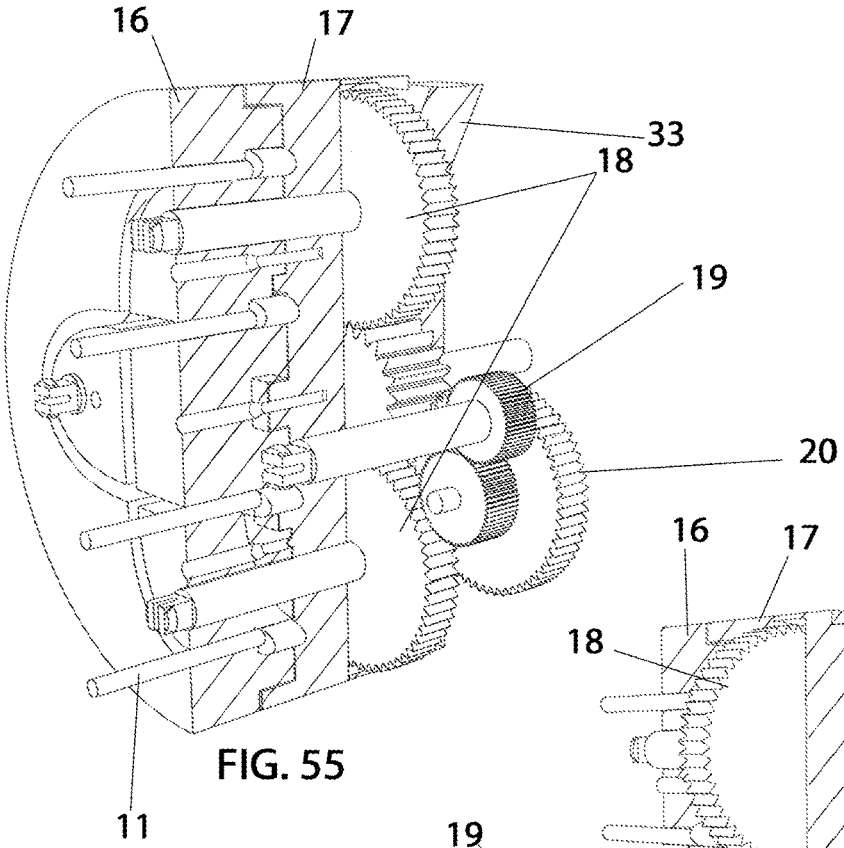
FIG. 55 shows a front three-quarters perspective view of a transamination and weaving mechanism of an embodiment of the present invention noting a plurality of support rods 11, a main track disk 16, a middle transmission disk 17, a plurality of 60-tooth clockwise gears 18, a plurality of 60-tooth counter-clockwise gears 19, a plurality of double gears 20, and a printed circuit board support 33.
Figure 56:
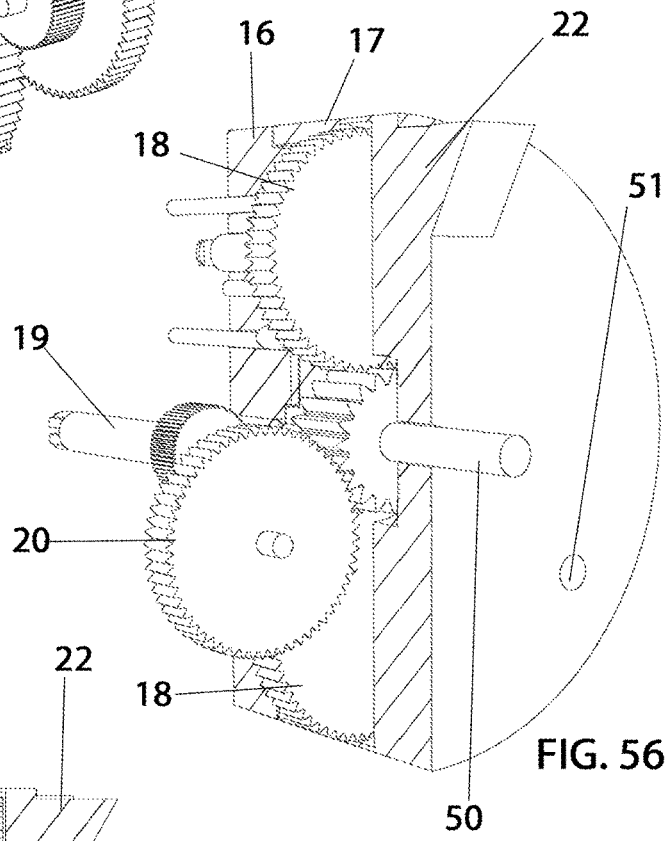
FIG. 56 shows a rear three-quarters perspective view of a transamination and weaving mechanism of an embodiment of the present invention noting a main track disk 16, a middle transmission disk 17, a plurality of 60-tooth clockwise gears 18, a plurality of 60-tooth counter-clockwise gears 19, a plurality of double gears 20, a gear cover 22, a motor axle 50, and a plurality of holes for disk screws 51.
Figure 57:
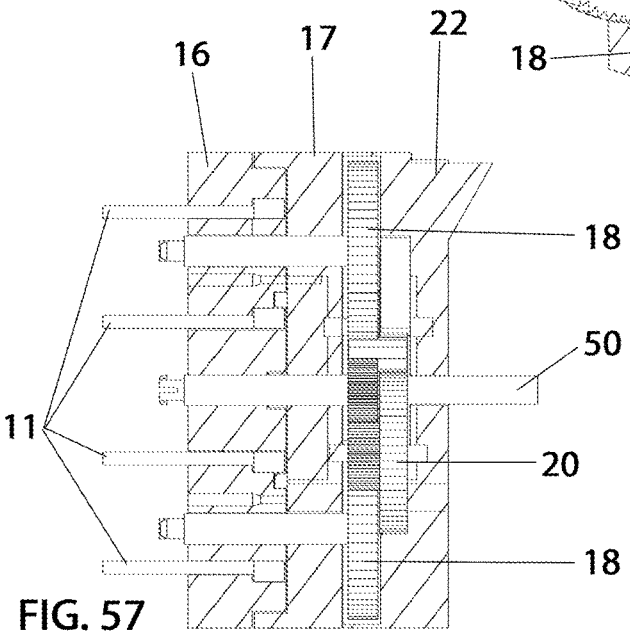
FIG. 57 shows a side view of a transamination and weaving mechanism of an embodiment of the present invention noting a plurality of support rods 11, a main track disk 16, a middle transmission disk 17, and a gear cover 22.

FIGS. 55-57 illustrate a transamination and weaving mechanism of an automatic hair braiding device from various perspectives. The transamination and weaving mechanism comprises a rotation track, a middle transmission disk, a gear cover, a plurality of horns, a plurality of support rods, a plurality of clockwise gears, a plurality of counter-clockwise gears, a plurality of double gears, and a plurality of driver gears. The transamination and weaving mechanism of the automatic hair braiding system is partially enclosed within the rear top housing and rear bottom housing of the automatic hair braiding device, to prevent dirt contamination of the mechanism. The transamination and weaving mechanism helps to drive the hair loading chambers during the braiding process.

FIG. 55 shows a front three-quarters perspective view of a transamination and weaving mechanism of an embodiment of the present invention noting a plurality of support rods 11, a main track disk 16, a middle transmission disk 17, a plurality of 60-tooth clockwise gears 18, a plurality of 60-tooth counter-clockwise gears 19, a plurality of double gears 20, and a printed circuit board support 33.

FIG. 56 shows a rear three-quarters perspective view of a transamination and weaving mechanism of an embodiment of the present invention noting a main track disk 16, a middle transmission disk 17, a plurality of 60-tooth clockwise gears 18, a plurality of 60-tooth counter-clockwise gears 19, a plurality of double gears 20, a gear cover 22, a motor axle 50, and a plurality of holes for disk screws 51.

FIG. 57 shows a side view of a transamination and weaving mechanism of an embodiment of the present invention noting a plurality of support rods 11, a main track disk 16, a middle transmission disk 17, and a gear cover 22.

FIGS. 58-63 illustrate a rotation track of an automatic hair braiding device from various perspectives. The rotation track of the automatic hair braiding system is partially enclosed within the rear top housing and rear bottom housing of the automatic hair braiding device, to prevent dirt contamination of the mechanism. The rotation track helps to drive the hair loading chambers during the braiding process.

Figure 58:
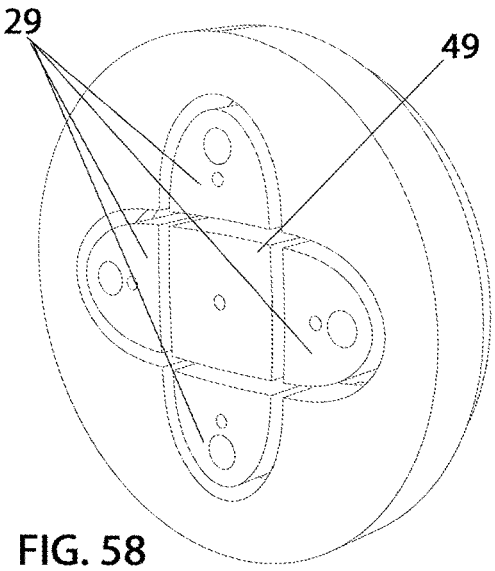
FIG. 58 shows a front three-quarters perspective view of a rotation track of an embodiment of the present invention noting a separate track support 29 and a center track support 49.

FIG. 58 shows a front three-quarters perspective view of a rotation track of an embodiment of the present invention noting a separate track support 29 and a center track support 49.

Figure 59:
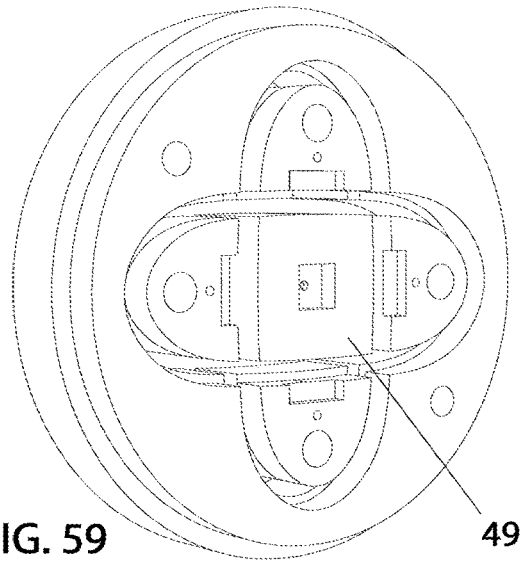
FIG. 59 shows a rear three-quarters perspective view of a rotation track of an embodiment of the present invention noting a center track support 49.

FIG. 59 shows a rear three-quarters perspective view of a rotation track of an embodiment of the present invention noting a center track support 49.

Figure 60:
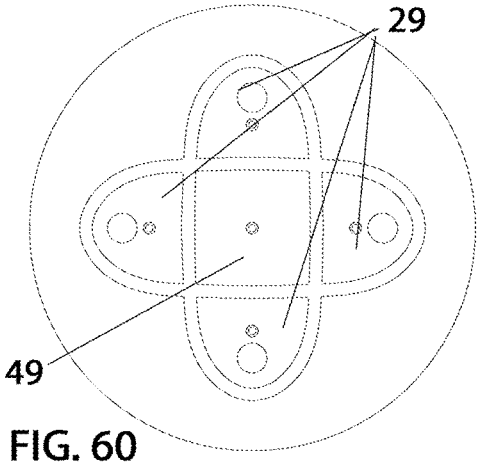
FIG. 60 shows a front view of a rotation track of an embodiment of the present invention noting a separate track support 29 and a center track support 49.

FIG. 60 shows a front view of a rotation track of an embodiment of the present invention noting a separate track support 29 and a center track support 49.

Figure 61:
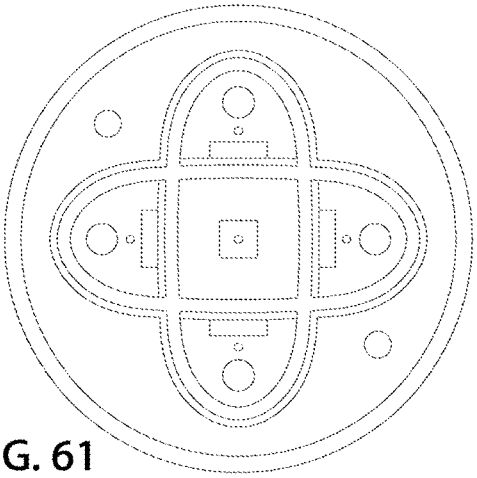
FIG. 61 shows a rear view of a rotation track of an embodiment of the present invention.

FIG. 61 shows a rear view of a rotation track of an embodiment of the present invention.

Figure 62:
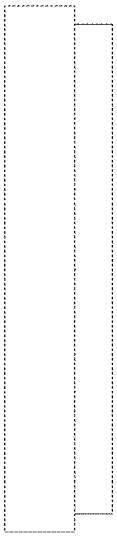
FIG. 62 shows a side view of a rotation track of an embodiment of the present invention.

FIG. 62 shows a side view of a rotation track of an embodiment of the present invention.

Figure 63:
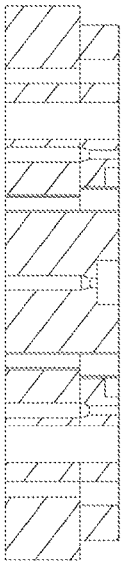
FIG. 63 shows a cutaway left side view of a rotation track of an embodiment of the present invention.

FIG. 63 shows a cutaway left side view of a rotation track of an embodiment of the present invention.

FIGS. 64-71 illustrate a middle transmission disk of an automatic hair braiding device from various perspectives. The middle transmission disk of the automatic hair braiding system is partially enclosed within the rear top housing and rear bottom housing of the automatic hair braiding device, to prevent dirt contamination of the mechanism. The middle transmission disk helps to drive the hair loading chambers during the braiding process.

FIG. 64 shows a front three-quarters perspective view of a middle transmission disk of an embodiment of the present invention noting a separate track support 29.

FIG. 65 shows a rear three-quarters perspective view of a middle transmission disk of an embodiment of the present invention noting a transition disk support 48.

FIG. 66 shows a front view of a middle transmission disk of an embodiment of the present invention noting a transition disk support 48 and a plurality of holes for gear axles 57.

FIG. 67 shows a rear view of a middle transmission disk of an embodiment of the present invention noting a plurality of holes for double gear axles 55.

FIG. 68 shows a side view of a middle transmission disk of an embodiment of the present invention noting a transition disk support 48.

FIG. 69 shows a top view of a middle transmission disk of an embodiment of the present invention noting a transition disk support 48.

FIG. 70 shows a cutaway left side view of a middle transmission disk of an embodiment of the present invention noting a plurality of holes for double gear axles 55.

FIG. 71 shows a cutaway top view of a middle transmission disk of an embodiment of the present invention noting a plurality of holes for double gear axles 55.

FIGS. 72-80 illustrate a gear cover of an automatic hair braiding device from various perspectives. The gear cover of the automatic hair braiding system is partially enclosed within the rear top housing and rear bottom housing of the automatic hair braiding device, to prevent dirt contamination of the mechanism. The gear cover helps to drive the hair loading chambers during the braiding process.

FIG. 72 shows a front three-quarters perspective view of a gear cover of an embodiment of the present invention noting a printed circuit board support 33.

FIG. 73 shows a rear three-quarters perspective view of a gear cover of an embodiment of the present invention noting a printed circuit board support 33.

FIG. 74 shows a top view of a gear cover of an embodiment of the present invention noting a printed circuit board support 33 and a transition disk support 48.

FIG. 75 shows a front view of a gear cover of an embodiment of the present invention noting a transition disk support 48, a plurality of holes for disk screws 51, a plurality of holes for double gear axles 55, and a hole for a motor gear axle 56.

FIG. 76 shows a bottom view of a gear cover of an embodiment of the present invention noting a printed circuit board support 33 and a transition disk support 48.

FIG. 77 shows a left side view of a gear cover of an embodiment of the present invention noting a printed circuit board support 33.

FIG. 78 shows a cutaway left side view of a gear cover of an embodiment of the present invention noting a printed circuit board support 33, a plurality of holes for double gear axles 55, and a hole for a motor gear axle 56.

FIG. 79 shows a rear view of a gear cover of an embodiment of the present invention noting a printed circuit board support 33, a plurality of holes for disk screws 51, and a hole for a motor gear axle 56.

FIG. 80 shows a cutaway top view of a gear cover of an embodiment of the present invention noting a plurality of holes for disk screws 51 and a hole for a motor gear axle 56.

FIGS. 81-83 illustrate a horn of an automatic hair braiding device from various perspectives. The horn of the automatic hair braiding system is partially enclosed within the rear top housing and rear bottom housing of the automatic hair braiding device, to prevent dirt contamination of the mechanism. The horn helps to drive the hair loading chambers during the braiding process.

FIG. 81 shows a front three-quarters perspective view of a horn of an embodiment of the present invention.

FIG. 82 shows a front view of a horn of an embodiment of the present invention.

FIG. 83 shows a cutaway left side view of a horn of an embodiment of the present invention noting a plurality of gear axle clips 47.

FIGS. 84-88 illustrate a support rod of an automatic hair braiding device from various perspectives. The support rod of the automatic hair braiding system is partially enclosed within the rear top housing and rear bottom housing of the automatic hair braiding device, to prevent dirt contamination of the mechanism. The support rod helps to drive the hair loading chambers during the braiding process.

Figure 84:
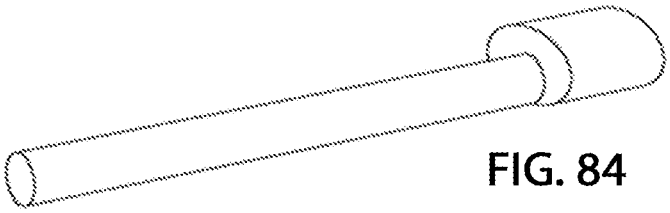
FIG. 84 shows a front three-quarters perspective view of a support rod of an embodiment of the present invention.

FIG. 84 shows a front three-quarters perspective view of a support rod of an embodiment of the present invention.

Figure 85:
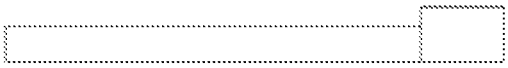
FIG. 85 shows a left side view of a support rod of an embodiment of the present invention.

FIG. 85 shows a left side view of a support rod of an embodiment of the present invention.

Figure 86:
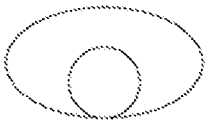
FIG. 86 shows a front view of a support rod of an embodiment of the present invention.

FIG. 86 shows a front view of a support rod of an embodiment of the present invention.

Figure 87:
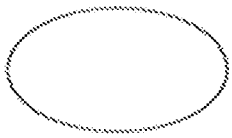
FIG. 87 shows a rear view of a support rod of an embodiment of the present invention.

FIG. 87 shows a rear view of a support rod of an embodiment of the present invention.

Figure 88:
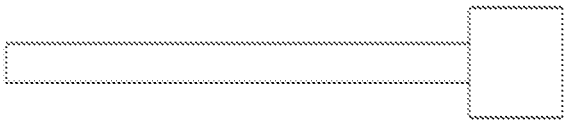
FIG. 88 shows a top view of a support rod of an embodiment of the present invention.

FIG. 88 shows a top view of a support rod of an embodiment of the present invention.

FIGS. 89-96 illustrate a clockwise gear of an automatic hair braiding device from various perspectives. The clockwise gear of the automatic hair braiding system is partially enclosed within the rear top housing and rear bottom housing of the automatic hair braiding device, to prevent dirt contamination of the mechanism. The clockwise gear helps to drive the hair loading chambers during the braiding process.

FIG. 89 shows a front three-quarters perspective view of a clockwise gear of an embodiment of the present invention noting a plurality of horn clips 34.

FIG. 90 shows a rear three-quarters perspective view of a clockwise gear of an embodiment of the present invention.

FIG. 91 shows a front view of a clockwise gear of an embodiment of the present invention.

FIG. 92 shows a rear view of a clockwise gear of an embodiment of the present invention.

FIG. 93 shows a left side view of a clockwise gear of an embodiment of the present invention noting a plurality of horn clips 34.

FIG. 94 shows a top view of a clockwise gear of an embodiment of the present invention noting a plurality of horn clips 34.

FIG. 95 shows a cutaway left side view of a clockwise gear of an embodiment of the present invention noting a plurality of horn clips 34.

FIG. 96 shows a cutaway top view of a clockwise gear of an embodiment of the present invention.

FIGS. 97-103 illustrate a counter-clockwise gear of an automatic hair braiding device from various perspectives. The counter-clockwise gear of the automatic hair braiding system is partially enclosed within the rear top housing and rear bottom housing of the automatic hair braiding device, to prevent dirt contamination of the mechanism. The counter-clockwise gear helps to drive the hair loading chambers during the braiding process.

Figure 97:
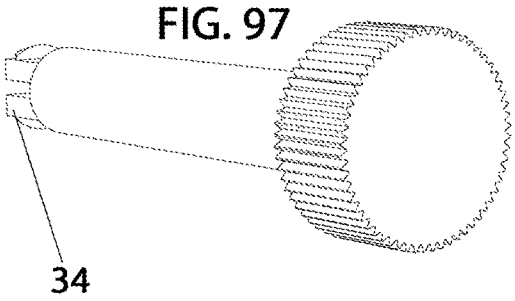
FIG. 97 shows a front three-quarters perspective view of a counter-clockwise gear of an embodiment of the present invention noting a plurality of horn clips 34.

FIG. 97 shows a front three-quarters perspective view of a counter-clockwise gear of an embodiment of the present invention noting a plurality of horn clips 34.

Figure 98:
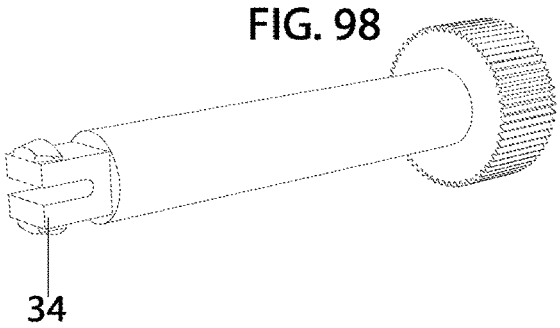
FIG. 98 shows a rear three-quarters perspective view of a counter-clockwise gear of an embodiment of the present invention noting a plurality of horn clips 34.

FIG. 98 shows a rear three-quarters perspective view of a counter-clockwise gear of an embodiment of the present invention noting a plurality of horn clips 34.

Figure 99:
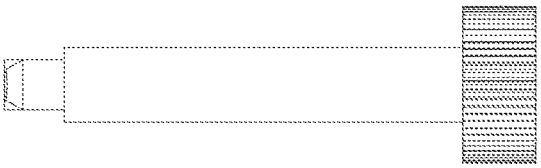
FIG. 99 shows a left side view of a counter-clockwise gear of an embodiment of the present invention.

FIG. 99 shows a left side view of a counter-clockwise gear of an embodiment of the present invention.

Figure 100:
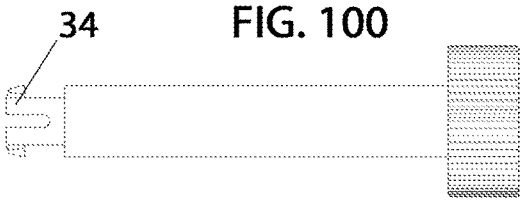
FIG. 100 shows a top view of a counter-clockwise gear of an embodiment of the present invention noting a plurality of horn clips 34.

FIG. 100 shows a top view of a counter-clockwise gear of an embodiment of the present invention noting a plurality of horn clips 34.

Figure 101:
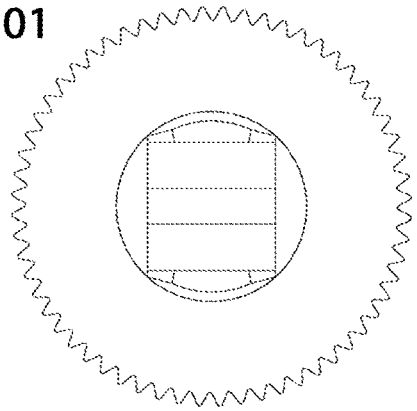
FIG. 101 shows a front view of a counter-clockwise gear of an embodiment of the present invention.

FIG. 101 shows a front view of a counter-clockwise gear of an embodiment of the present invention.

Figure 102:
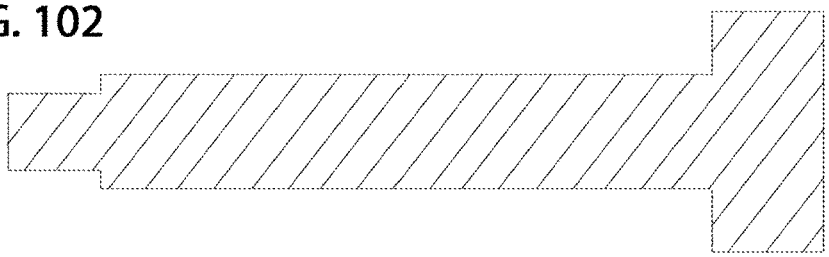
FIG. 102 shows a cutaway left side view of a counter-clockwise gear of an embodiment of the present invention.

FIG. 102 shows a cutaway left side view of a counter-clockwise gear of an embodiment of the present invention.

Figure 103:
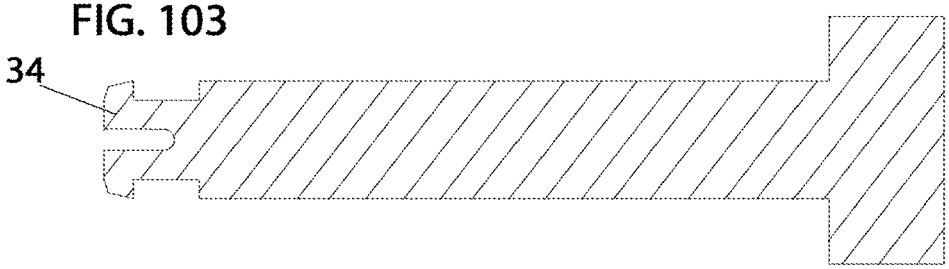
FIG. 103 shows a cutaway top view of a counter-clockwise gear of an embodiment of the present invention noting a plurality of horn clips 34.

FIG. 103 shows a cutaway top view of a counter-clockwise gear of an embodiment of the present invention noting a plurality of horn clips 34.

FIGS. 104-107 illustrate a double gear of an automatic hair braiding device from various perspectives. The double gear of the automatic hair braiding system is partially enclosed within the rear top housing and rear bottom housing of the automatic hair braiding device, to prevent dirt contamination of the mechanism. The double gear helps to drive the hair loading chambers during the braiding process.

Figure 104:
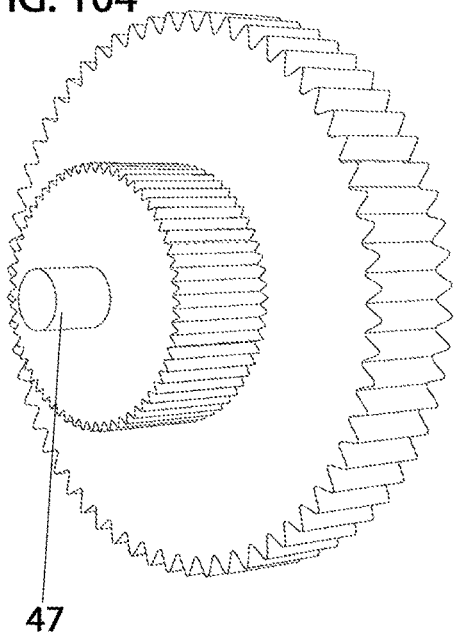
FIG. 104 shows a front three-quarters perspective view of a double gear of an embodiment of the present invention noting a plurality of gear axle clips 47.

FIG. 104 shows a front three-quarters perspective view of a double gear of an embodiment of the present invention noting a plurality of gear axle clips 47.

Figure 105:
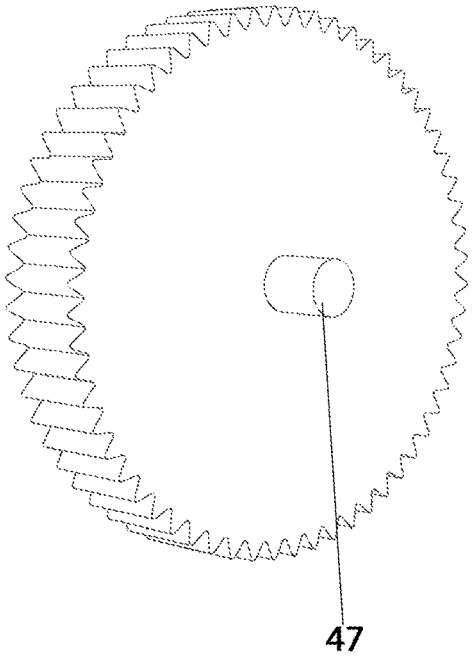
FIG. 105 shows a rear three-quarters perspective view of a double gear of an embodiment of the present invention noting a plurality of gear axle clips 47.

FIG. 105 shows a rear three-quarters perspective view of a double gear of an embodiment of the present invention noting a plurality of gear axle clips 47.

Figure 106:
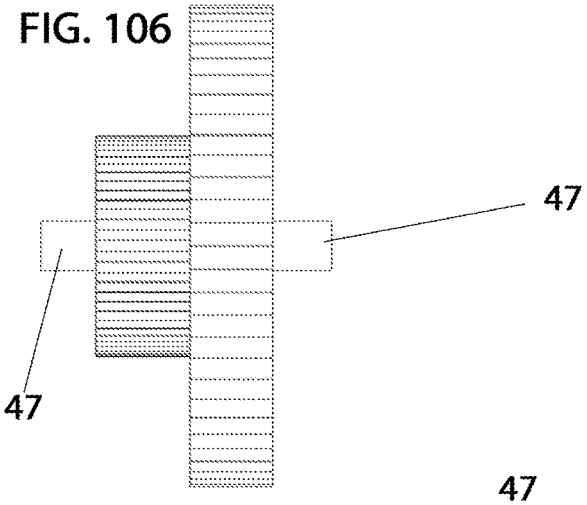
FIG. 106 shows a left side view of a double gear of an embodiment of the present invention noting a plurality of gear axle clips 47.

FIG. 106 shows a left side view of a double gear of an embodiment of the present invention noting a plurality of gear axle clips 47.

Figure 107:
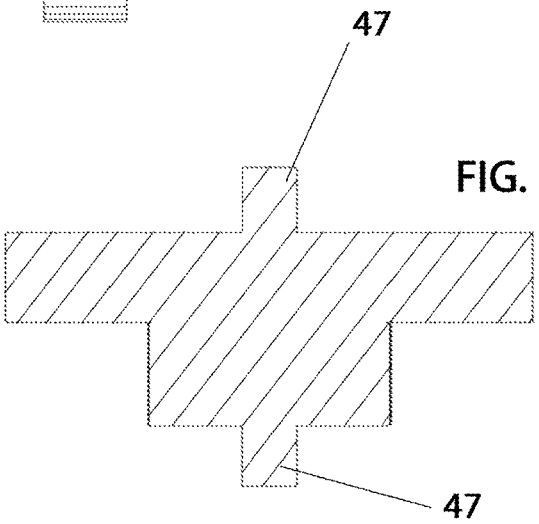
FIG. 107 shows a cutaway top view of a double gear of an embodiment of the present invention noting a plurality of gear axle clips 47.

FIG. 107 shows a cutaway top view of a double gear of an embodiment of the present invention noting a plurality of gear axle clips 47.

FIGS. 108-115 illustrate a driver gear of an automatic hair braiding device from various perspectives. The driver gear of the automatic hair braiding system is partially enclosed within the rear top housing and rear bottom housing of the automatic hair braiding device, to prevent dirt contamination of the mechanism. The driver gear helps to drive the hair loading chambers during the braiding process.

FIG. 108 shows a front three-quarters perspective view of a driver gear of an embodiment of the present invention.

FIG. 109 shows a rear three-quarters perspective view of a driver gear of an embodiment of the present invention noting a flat notch 35.

FIG. 110 shows a front view of a driver gear of an embodiment of the present invention.

FIG. 111 shows a left side view of a driver gear of an embodiment of the present invention.

FIG. 112 shows a rear view of a driver gear of an embodiment of the present invention noting a flat notch 35.

FIG. 113 shows a cutaway left side view of a driver gear of an embodiment of the present invention noting a flat notch 35.

FIG. 114 shows a cutaway top view of a driver gear of an embodiment of the present invention.

FIG. 115 shows a cutaway bottom view of a driver gear of an embodiment of the present invention noting a flat notch 35.

Figure 116:
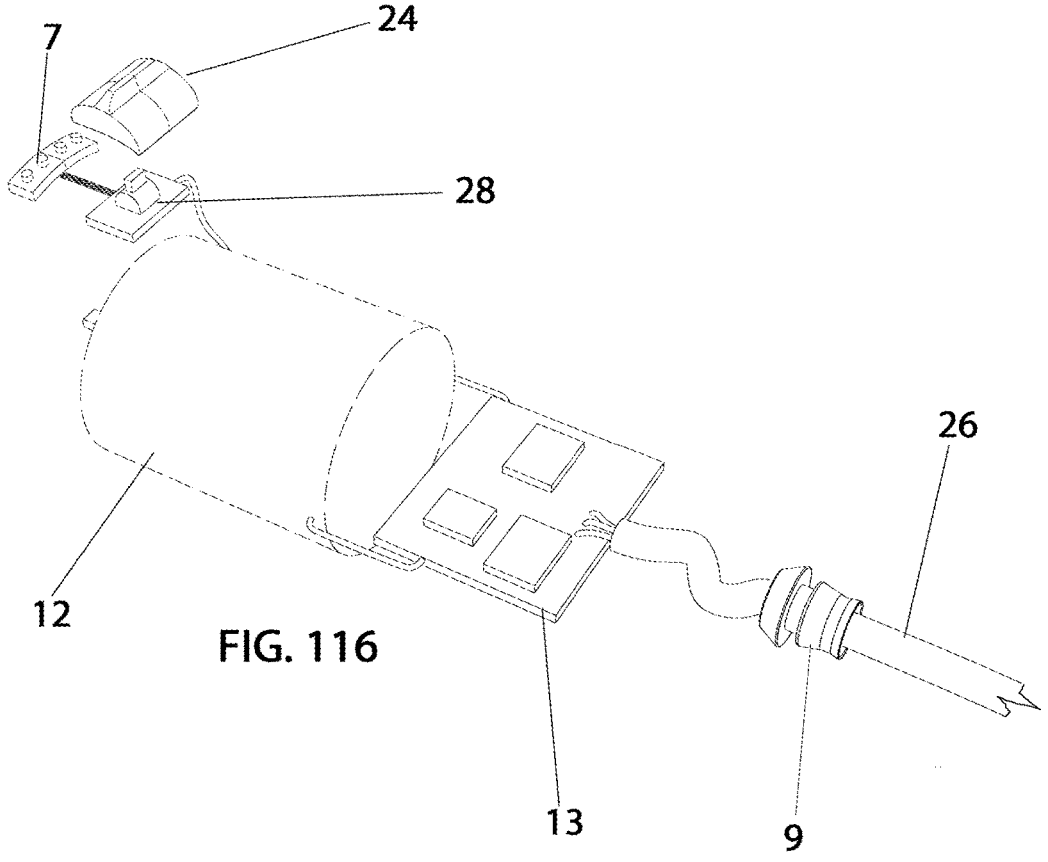
FIG. 116 shows a plurality of electronic components of an embodiment of the present invention noting a plurality of LED lights 7, a rubber power supply cable ring 9, an electric motor 12, a printed circuit board 13, a grip for a rocker switch 24, a plurality of holes in a rear top housing 26 for a plurality of LEDs, and a rocker switch 28.

FIG. 116 illustrates a plurality of electronic components of an automatic hair braiding device from various perspectives. plurality of electronic components of the automatic hair braiding system are partially enclosed within the rear top housing and rear bottom housing of the automatic hair braiding device, to prevent dirt contamination of the mechanism. The plurality of electronic components of an automatic hair braiding system power and control the drive mechanism for the device, while also allowing for User modification of the device settings through a computer or Bluetooth interface.

FIG. 116 shows a plurality of electronic components of an embodiment of the present invention noting a plurality of LED lights 7, a rubber power supply cable ring 9, an electric motor 12, a printed circuit board 13, a grip for a rocker switch 24, a plurality of holes in a rear top housing 26 for a plurality of LEDs, and a rocker switch 28.

FIGS. 117-125 illustrate a hair chamber of an automatic hair braiding device from various perspectives. The plurality of hair chambers of the automatic hair braiding system are partially enclosed by the front housing of the device. These hair chambers allow for manipulation of a User's hair during the hair braiding process, and are driven by the gear mechanism and circuitry of the automatic hair braiding device.

FIG. 117 shows a left side view of a hair chamber of an embodiment of the present invention noting a rubber nozzle 14, a hair chamber top 36, a hair chamber bottom 37, and a chamber hook 38.

FIG. 118 shows a top view of a hair chamber of an embodiment of the present invention noting a rubber nozzle 14, a hair chamber top 36, a hair chamber bottom 37, and a chamber hook 38.

FIG. 119 shows a front view of a hair chamber of an embodiment of the present invention noting a rubber nozzle 14, a hair chamber bottom 37, and a chamber hook 38.

FIG. 120 shows a bottom view of a hair chamber of an embodiment of the present invention.

FIG. 121 shows a rear view of a hair chamber of an embodiment of the present invention noting a hair chamber bottom 37, a chamber hook 38, and a plurality of holes for support rods 43.

FIG. 122 shows a cutaway left side view of a hair chamber of an embodiment of the present invention noting a rubber nozzle 14, a chamber hook 38, and a chamber divider 39.

FIG. 123 shows an exploded front three-quarters perspective view of a hair chamber of an embodiment of the present invention noting a rubber nozzle 14, a hair chamber top 36, a hair chamber bottom 37, a chamber divider 39, a release for a chamber top 42, a recess for a hook release 44, and a loading hook 45.

FIG. 124 shows an exploded rear three-quarters perspective view of a hair chamber of an embodiment of the present invention noting a rubber nozzle 14, a hair chamber top 36, a hair chamber bottom 37, a chamber hook 38, a chamber divider 39, and a plurality of holes for support rods 43.

FIG. 125 shows an exploded cutaway left side view of a hair chamber of an embodiment of the present invention noting a rubber nozzle 14, a chamber divider 39, a chamber support for a divider 40, a release for a chamber top 42, and a plurality of holes for support rods 43.

In more detail the plurality of hair loading chambers 8 may further comprise a front side and a rear side, where the front side is nearest to the front of the automatic hair braiding device and engages the hair of a user, and the rear side is nearest to the geometric center of the device and is attached to a front side of the transamination and weaving mechanism. The rear side of each of the plurality of hair loading chambers 8 may be attached to the transamination and weaving mechanism by any appropriate means such as, for example, having one each of the plurality of support rods 11, which project from the front side of the transamination and weaving mechanism, inserted into one each of the plurality of hair loading chambers 8. In this way the movement of the plurality of support rods 11 by the transamination and weaving mechanism results in the movement of the plurality of hair loading chambers 8.

The electric motor 12 may further comprise a front side, from which may project a motor axle 50, and a rear side, which may comprise a plurality of electrical connections to the plurality of wiring 31. The motor axle 50 on the front of the electric motor 12 may project into a rear side of the transamination and weaving mechanism and be attached to a driver gear within the transamination and weaving mechanism. The rotation of the motor axle 50 by the electric motor 12 may result in the rotation of the driver gear within the transamination and weaving mechanism and, thus, the rotation of the plurality of 60-tooth counter-clockwise gears 19, plurality of 60-tooth clockwise gears 18, middle transmission disk 17, main track disk 16, plurality of track disk screws 15, plurality of support rods 11, plurality of horns 10, and the plurality of hair loading chambers 8.

The rear side of the electric motor 12 may comprise a plurality of electrical connections such as, for example, soldered connections, to a first end of the plurality of wiring 31, and a second end of the plurality of wiring 31 may be connected to the printed circuit board 13 by a plurality of electrical connections such as, for example, soldered connections. The printed circuit board 13 may be further connected to the power cord, the plurality of LED lights 7, and the rocker switch 28 via the plurality of wiring 31 by a plurality of electrical connections such as, for example, soldered connections.

The rear bottom housing 1 may further comprise a plurality of holes for screws 30 that align with a plurality of screw receivers in the rear top housing 2 when they are placed against one another. In this way the rear bottom housing 1 and rear top housing 2 may be removably attached to one another using a plurality of rear housing screws 23.

A front edge of the rear bottom housing 1 and a front edge of the rear top housing 2 may be inserted into a rear edge of the front housing 3, and may be reversibly attached to the front housing 3 by any appropriate means such as, for example, the insertion of the plurality of clips in a front housing 52 into the a plurality of long grooves 58.

The automatic hair braiding device disclosed herein may be substantially constructed of any suitable material or combination of materials, but typically is constructed of a resilient plastic or combination of plastics such that the combination is resistant to wear and damage as a result of everyday use. As an example, and without limiting the scope of the present invention, various exemplary embodiments of the automatic hair braiding device disclosed herein may be substantially constructed of one or more materials of acrylonitrile butadiene styrene, polyvinyl chloride, polypropylene, polycarbonate, fiberglass, carbon fiber, aluminum, steel, brass, or combinations thereof. The thickness of the material used in each component may vary as desired. Additionally, one or more additional materials may be added to impart the desired amount of resiliency or elasticity, such as elastane, rubber, or latex.

The plurality of mechanical components of the automatic hair braiding device disclosed herein may be substantially constructed of any suitable solid or semi-solid materials, but typically are constructed of a resilient material or combination of materials such that the combination is resistant to compression, flexing, and crush damage as a result of everyday use. As an example, and without limiting the scope of the present invention, various exemplary embodiments of the mechanical components may be substantially constructed of one or more materials of plastic, wood, fiberglass, carbon fiber, aluminum, steel, brass, or combinations thereof. The thickness of the material used in each component may vary as desired.

Note with respect to the materials of construction, it is not desired nor intended to thereby unnecessarily limit the present invention by reason of such disclosure.

An automatic hair braiding device disclosed herein has been described. The foregoing description of the various exemplary embodiments of the invention has been presented for the purposes of illustration and disclosure. It is not intended to be exhaustive or to limit the invention to the precise form disclosed. Many modifications and variations are possible in light of the above teaching without departing from the spirit of the invention.

While the invention has been described in connection with what is presently considered to be the most practical and preferred embodiments, it is to be understood that the invention is not to be limited to the disclosed embodiments, but on the contrary, is intended to cover various modifications and equivalent arrangements included within the spirit and scope of the appended claims.

We claim:

1. An automatic hair braiding device, comprising:

a plurality of hair chambers each having a front side and a rear side;

a transamination and weaving mechanism having a front side and a rear side;

an electric gear motor having a front side and a rear side;

a printed circuit board;

a power cord;

a plurality of LED lights; and a rocker switch;

wherein said rear sides of said plurality of hair chambers are attached to said front side of said transamination and weaving mechanism;

wherein said rear side of said transamination and weaving mechanism is attached to said front side of said electric gear motor;

wherein said rear side of said electric gear motor is attached to said printed circuit board;

wherein said printed circuit board is attached to said power cord;

wherein said printed circuit board is attached to said plurality of LED lights; and wherein said printed circuit board is attached to said rocker switch.

2. The invention of claim 1, further comprising:

a computer interface software;

wherein said computer interface software may be used to control said printed circuit board.

3. The invention of claim 2, further comprising:

a Bluetooth interface software;

wherein said Bluetooth interface software may be used to control said printed circuit board.

4. The invention of claim 3, further comprising:

a rear top housing having a front side, a rear side, and a bottom side;

a rear bottom housing having a front side, a rear side, and a top side; and a front housing having a front side, a rear side, a hinge mechanism, and a plurality of side openings;

wherein said bottom side of said rear top housing is attached to said top side of said rear bottom housing; and wherein said front housing is attached to said front side of said rear top housing and said front side of said rear bottom housing.

5. The invention of claim 4, further comprising:

a transparent lid having a hinge mechanism; and a plurality of transparent side panels;

wherein said hinge mechanism of said transparent lid is attached to said hinge mechanism of said front housing; and wherein said plurality of transparent side panels are attached to said plurality of side openings of said front housing.

6. The invention of claim 5, wherein said rear top housing and said rear bottom housing together comprise a shell disposed around said transamination and weaving mechanism, said electric gear motor, and said printed circuit board.

7. The invention of claim 6, wherein said front housing, said transparent lid, and said plurality of transparent side panels together comprise a shell disposed around said plurality of hair chambers.

* * * * *